US008133030B2

(12) United States Patent
Grafitti et al.

(10) Patent No.: US 8,133,030 B2
(45) Date of Patent: Mar. 13, 2012

(54) AIRFOIL SHAPE

(75) Inventors: Andrew D. Grafitti, Greenville, SC (US); Louis Veltre, Simpsonville, SC (US); Thomas W. Vandeputte, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 587 days.

(21) Appl. No.: 12/570,265

(22) Filed: Sep. 30, 2009

(65) Prior Publication Data

US 2011/0076150 A1 Mar. 31, 2011

(51) Int. Cl.
*F01D 5/14* (2006.01)

(52) U.S. Cl. ..... 416/223 A; 416/243; 416/DIG. 2

(58) Field of Classification Search ..... 416/23, 416/223 R, 223 A, 243, DIG. 2, DIG. 5
See application file for complete search history.

(56) References Cited

U.S. PATENT DOCUMENTS

| | | | | |
|---|---|---|---|---|
| 7,497,665 | B2 * | 3/2009 | King et al. | 416/223 A |
| 7,510,378 | B2 * | 3/2009 | LaMaster et al. | 416/223 A |
| 7,520,729 | B2 * | 4/2009 | McGowan et al. | 416/223 R |
| 7,534,092 | B2 * | 5/2009 | Columbus et al. | 416/223 R |
| 7,534,093 | B2 * | 5/2009 | Spracher et al. | 416/223 A |
| 7,534,094 | B2 * | 5/2009 | Tomberg et al. | 416/223 A |
| 7,537,434 | B2 * | 5/2009 | Cheruku et al. | 416/223 R |
| 7,537,435 | B2 * | 5/2009 | Radhakrishnan et al. | 416/223 A |
| 7,540,715 | B2 * | 6/2009 | Latimer et al. | 416/223 A |
| 7,837,445 | B2 * | 11/2010 | Benjamin et al. | 416/223 A |

* cited by examiner

*Primary Examiner* — Edward Look
*Assistant Examiner* — Ryan Ellis
(74) *Attorney, Agent, or Firm* — Ernest G. Cusick; Frank A. Landgraff

(57) ABSTRACT

An article of manufacture having a nominal profile substantially in accordance with Cartesian coordinate values of X, Y and Z set forth in a table. The table selected from the TABLE. Wherein X and Y are distances in inches which, when connected by smooth continuing arcs, define airfoil profile sections at each distance Z in inches. The profile sections at the Z distances being joined smoothly with one another to form a complete airfoil shape.

9 Claims, 8 Drawing Sheets

AIRFOIL SHAPE

BACKGROUND OF THE INVENTION

The present invention relates to airfoils for a rotor bucket of a gas turbine. In particular, the invention relates to airfoil profiles for either inlet guide vanes, rotors, or stators at various stages.

In a gas turbine, many system requirements should be met at each stage of a gas turbine's flow path section to meet design goals. These design goals include, but are not limited to, overall improved efficiency and airfoil loading capability. For example, and in no way limiting of the invention, a bucket should achieve thermal and mechanical operating requirements for that particular stage. Further, for example, and in no way limiting of the invention, a bucket should achieve thermal and mechanical operating requirements for that particular stage.

BRIEF DESCRIPTION OF THE INVENTION

In accordance with one embodiment of the instant invention, there is provided an airfoil shape for a rotor bucket of a gas turbine that enhances the performance of the gas turbine. The airfoil shape hereof also improves the interaction between various stages and affords improved aerodynamic efficiency, while simultaneously reducing tenth stage airfoil thermal and mechanical stresses.

The rotor bucket airfoil profile, as embodied by the invention, is defined by unique loci of points to achieve the necessary efficiency and loading requirements whereby improved performance is obtained. These unique loci of points define the nominal airfoil profile and are identified by the X, Y and Z Cartesian coordinates of various Tables that follow. The points for the coordinate values shown in Table 1 relative to the engine centerline and for a cold, i.e., room temperature bucket at various cross-sections of the bucket's airfoil along its length. The positive X, Y and Z directions are axial toward the exhaust end of the turbine, tangential in the direction of engine rotation and radially outwardly toward the static case, respectively. The X, Y, and Z coordinates are given in distance dimensions, e.g., units of inches, and are joined smoothly at each Z location to form a smooth continuous airfoil cross-section. Each defined airfoil section in the X, Y plane is joined smoothly with adjacent airfoil sections in the Z direction to form the complete airfoil shape.

It will be appreciated that an airfoil heats up during use, as known by a person of ordinary skill in the art. The airfoil profile will thus change as a result of mechanical loading and temperature. Accordingly, the cold or room temperature profile, for manufacturing purposes, is given by X, Y and Z coordinates. A distance of plus or minus about 0.160 inches from the nominal profile in a direction normal to any surface location along the nominal profile and which includes any coating, defines a profile envelope for this rotor bucket airfoil, because a manufactured rotor bucket airfoil profile may be different from the nominal airfoil profile given by the following tables. The airfoil shape is robust to this variation, without impairment of the mechanical and aerodynamic functions of the bucket.

The airfoil, as embodied by the invention, can be scaled up or scaled down geometrically for introduction into similar turbine designs. Consequently, the X, Y, and Z coordinates of the nominal airfoil profile may be a function of a constant. That is, the X, Y and Z coordinate values may be multiplied or divided by the same constant or number to provide a "scaled-up" or "scaled-down" version of the rotor bucket airfoil profile, while retaining the airfoil section shape, as embodied by the invention.

In one embodiment of the invention, a turbine bucket comprises a bucket airfoil having an airfoil shape, the airfoil having a nominal profile substantially in accordance with Cartesian coordinate values of X, Y and Z set forth in Table 1. X and Y are distances which, when connected by smooth continuing arcs, define airfoil profile sections at each distance Z in inches. The profile sections at the Z distances are joined smoothly with one another to form a complete airfoil shape.

In another embodiment according to the invention, a bucket includes a rotor bucket airfoil having an uncoated nominal airfoil profile substantially in accordance with Cartesian coordinate values of X, Y and Z set forth in Table 1. X and Y are distances in inches which, when connected by smooth continuing arcs, define airfoil profile sections at each Z distance in inches. The profile sections at the Z distances are joined smoothly with one another to form a complete airfoil shape. X and Y distances are scalable as a function of a constant to provide a scaled-up or scaled-down airfoil.

In a further embodiment of the invention, a turbine comprises a wheel having a plurality of rotor buckets. Each of the buckets includes an airfoil having an airfoil shape. The airfoil comprises a nominal profile substantially in accordance with Cartesian coordinate values of X, Y and Z set forth in Table 1. X and Y are distances in inches which, when connected by smooth continuing arcs, define the airfoil profile sections at each distance Z in inches. The profile section at the Z distances are joined smoothly with one another to form a complete airfoil shape.

In a yet further embodiment of the invention, a turbine comprises a wheel having a plurality of buckets, and each of the buckets include an airfoil having an uncoated nominal airfoil profile substantially in accordance with Cartesian coordinate values of X, Y and Z set forth in Table 1. X and Y are distances which, when connected by smooth continuing arcs, define airfoil profile sections at each distance Z in inches. The profile sections at the Z distances are joined smoothly with one another to form a complete airfoil shape. The X, Y, and Z distances are scalable as a function of a constant to provide a scaled-up or scaled-down rotor bucket airfoil.

DETAILED DESCRIPTION OF THE INVENTION

Figure 1:
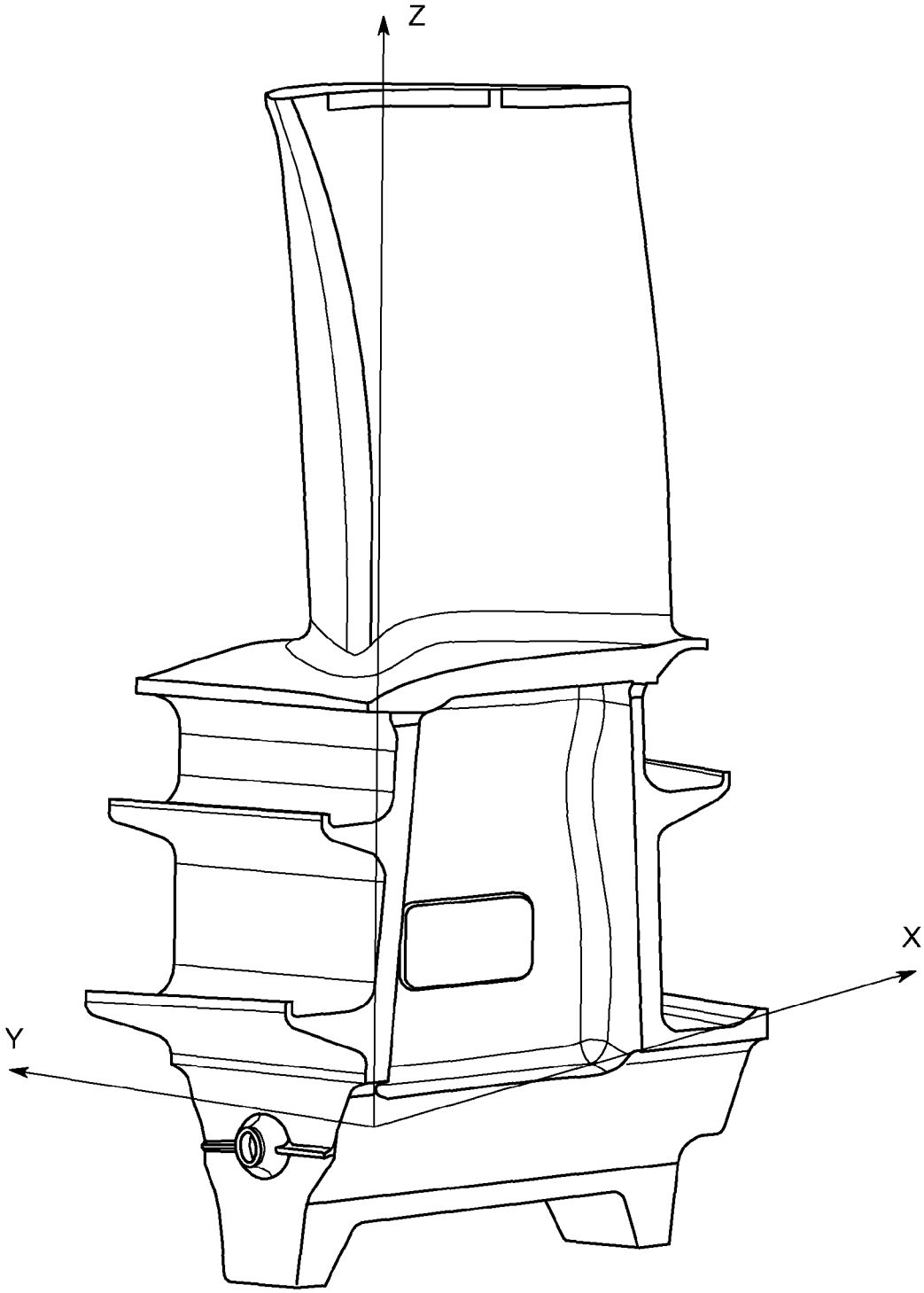
FIG. 1 is an isometric illustration of the bucket airfoil, as embodied by the invention, with a coordinate system superimposed thereon.

Referring now to the drawings, FIG. 1 an isometric illustration of the turbine bucket airfoil, as embodied by the invention, with a coordinate system superimposed thereon. The turbine bucket airfoil 10 comprises a base 11 and an airfoil portion 12. Also illustrated in FIG. 1 is a Cartesian coordinate system, shown with axes X, Y, and Z. These axes are based on a system relative to an engine coordinate.

The X and Y coordinates, and their values (described hereinafter) are given in distance dimensions, where the Z coordinate is in a normalized form. These coordinates, however, are based on a system relative to the engine coordinate system. Moreover, the coordinates however, are based on a system relative to the engine coordinate system.

The engine coordinate system is defined having the X axis in engine an axial engine direction, the Y axis in a circumferential direction, and the Z axis in the radial (outward) engine direction from the engine centerline as shown in FIG. 1. The coordinate system that defines the profile however, is based on its own geometry and is relative to the aforementioned engine coordinate system. This relative coordinate system, as embodied by the invention, is based on a reference plane (FIG. 2) defined by three points located on the bucket airfoil.

Figure 2:
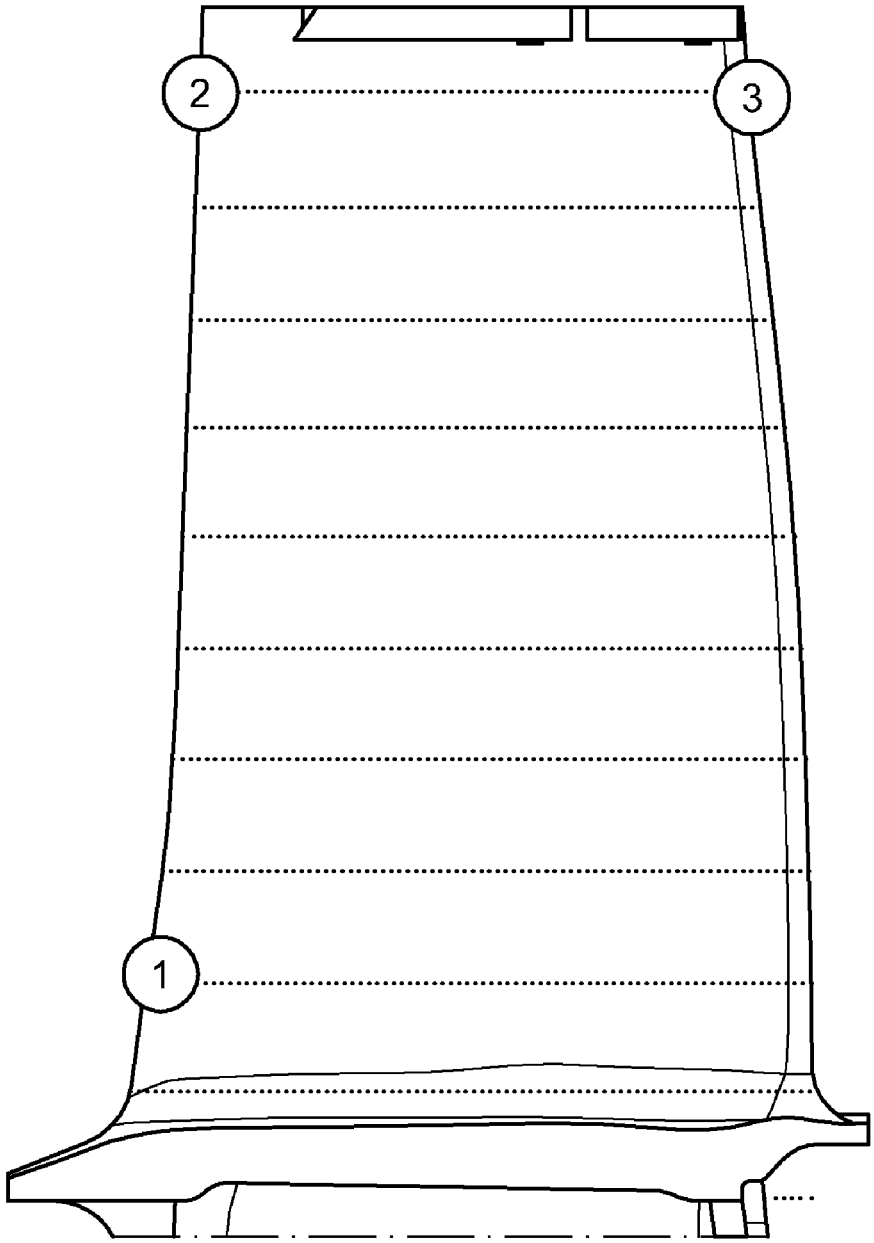
FIG. 2 is a side isometric illustration of the bucket airfoil, as embodied by the invention.
Figure 3:
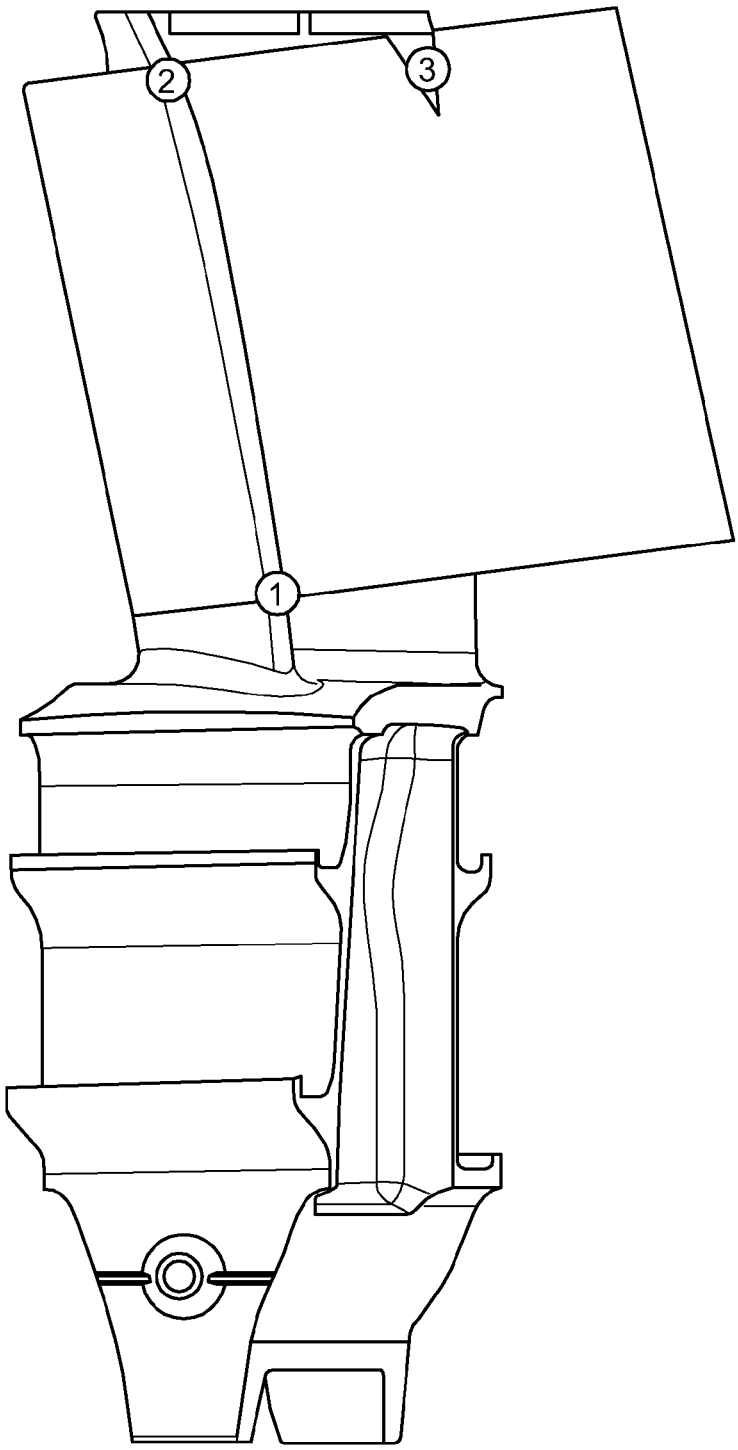
FIG. 3 is a side isometric illustration of the bucket airfoil, as embodied by the invention, with a resultant reference plane.

The plane illustrated in FIG. 2 is oriented such that it is generally aligned with the leading edge and the chord line of the turbine bucket airfoil 10, as embodied by the invention. The first two points of the plane are located along the leading edge, as seen in FIG. 2, this will define Z axis. The topmost point 2 is intended to be high along the turbine bucket airfoil 10, but be kept below the tip shelf to avoid any fillets and cooling holes. With this radial location, the point on the turbine bucket airfoil 10 that has the minimum axial location is used to define this point in space. This point, referenced as point 2, is also the origin of a new coordinate system. The bottom most point 1 along a leading edge of the turbine bucket airfoil 10 is intended to be close to the turbine bucket airfoil 10 platform 13 at the base 11, but to be above the airfoil fillet. Similarly while keeping the radial location, the point on the turbine bucket airfoil 10 with the minimum axial location is used to define this point in space. The third point 3 that defines a plane is located along a trailing edge of the turbine bucket airfoil 10. This point will orient the plane along the chord line of the turbine bucket airfoil 10, which will be the direction of the relative X axis. It is defined by the axial coordinate along the same radial position as point 2. The resultant plane 15 is illustrated in FIG. 3.

Figure 4:
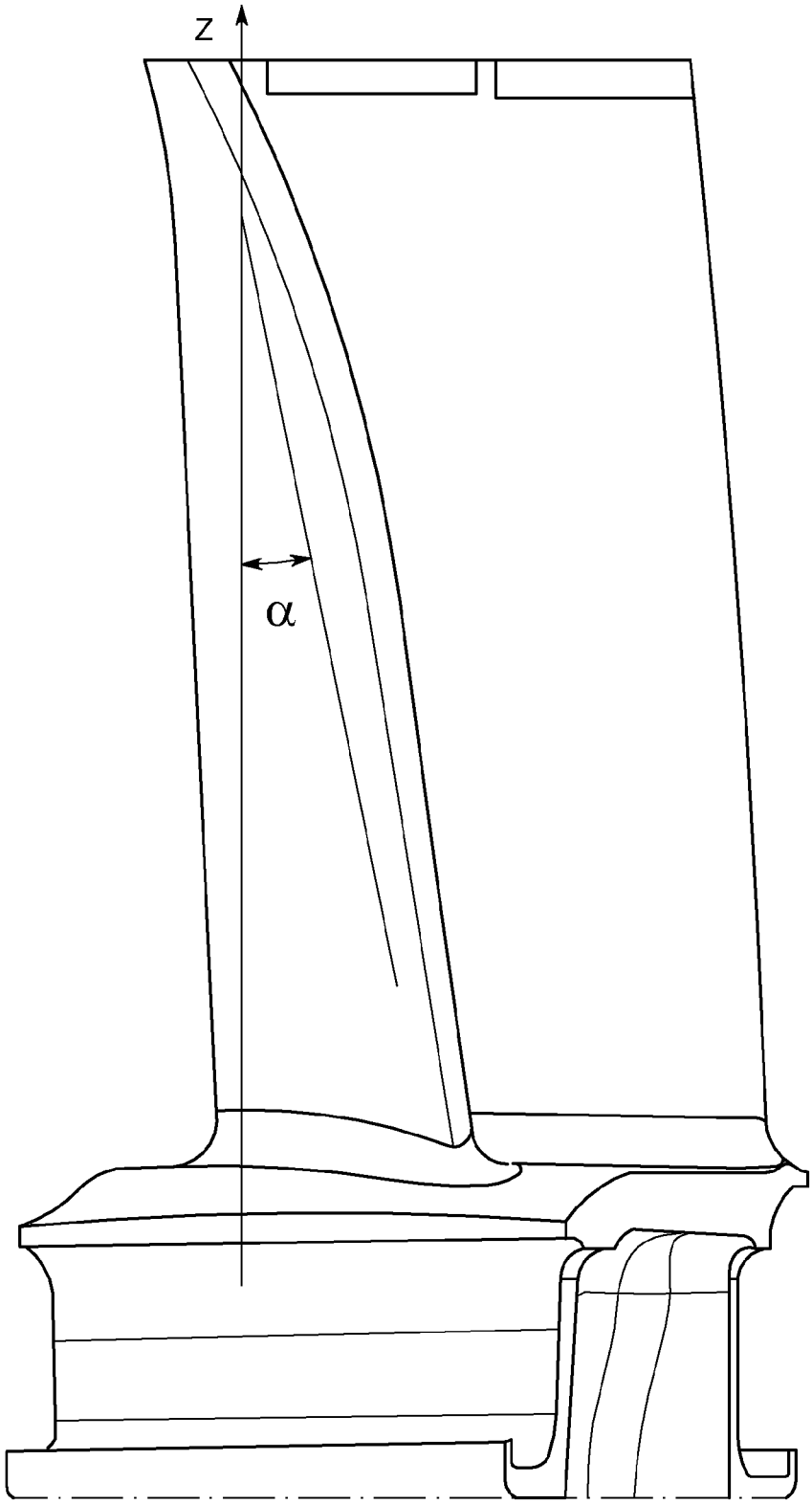
FIG. 4 is an axial view of a bucket airfoil, as embodied by the invention, with axis Z being shown in absolute.
Figure 5:
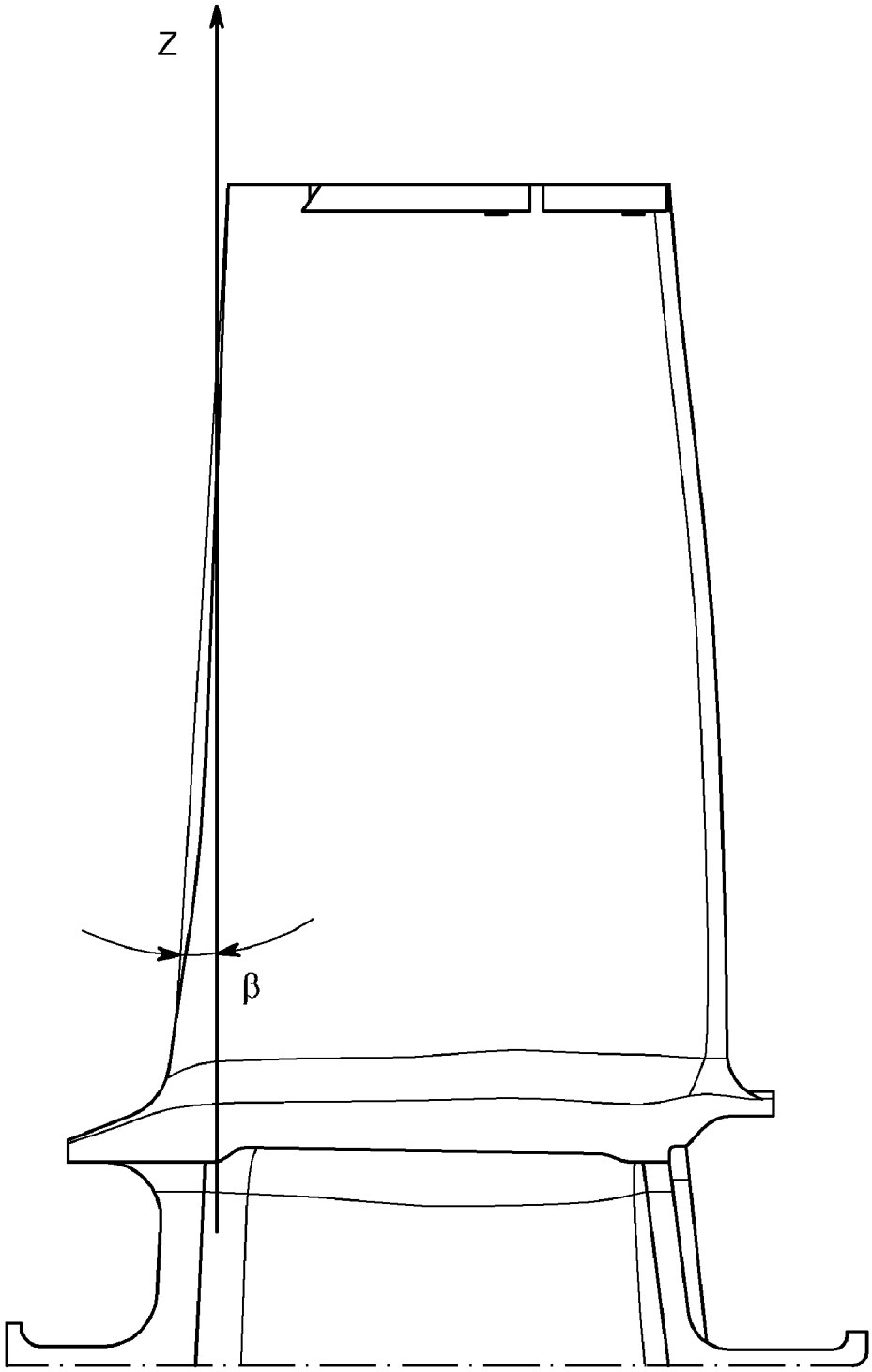
FIG. 5 is a front isometric illustration of the bucket airfoil, as embodied by the invention, with axis Z being shown in absolute.
Figure 6:
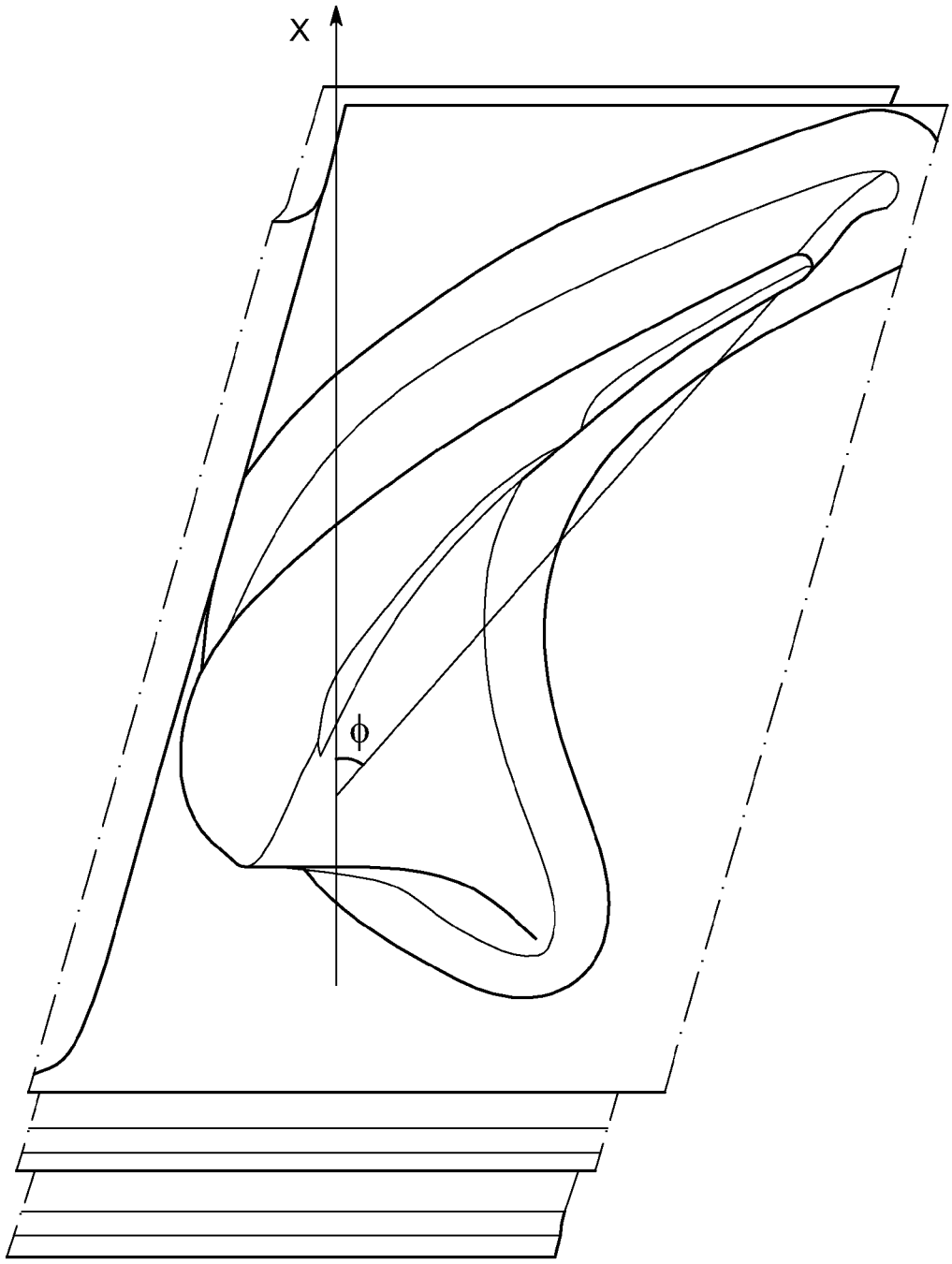
FIG. 6 is a top isometric illustration of the bucket airfoil, as embodied by the invention, with axis X being shown in absolute.
Figure 7:
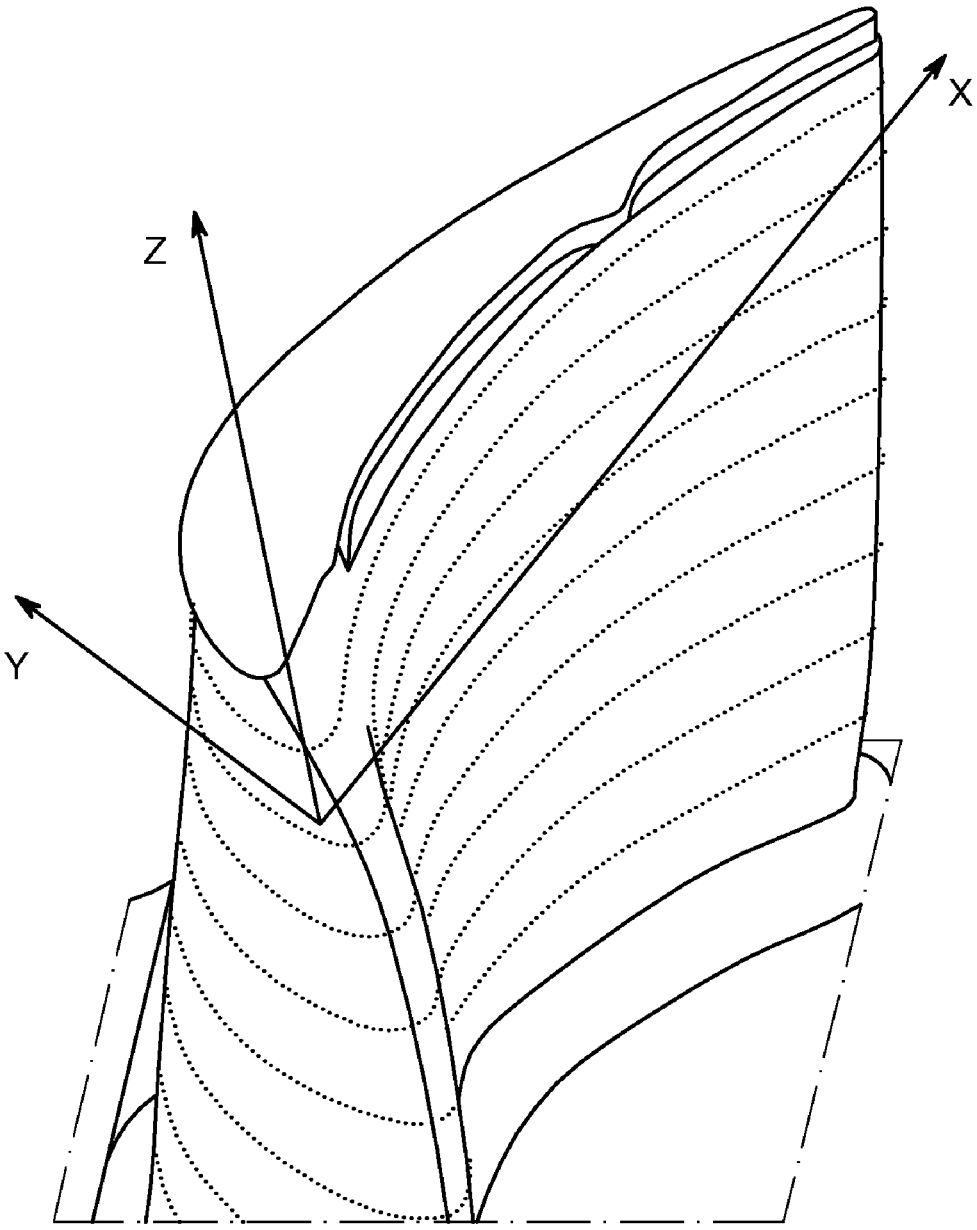
FIG. 7 is an isometric illustration of the bucket airfoil, as embodied by the invention, with the relative coordinate system being shown.

Comparing this plane 15 to the engine coordinate system, at least three angles of orientation are defined, as embodied by the invention. These angles define how the relative coordinate system can be rotated to align with the leading edge and chord line, and are illustrated in FIGS. 4-6. The rotated relative coordinate system can be seen in FIG. 7, it is aligned with the turbine bucket airfoil 10 and is easily defined in accordance with the reference frame. Since it is a relative coordinate system based on the turbine bucket airfoil 10 geometry, it can be used to define sectioned points that make up the turbine bucket airfoil 10 profile.

As embodied by the invention, in FIG. 4, the angle $\alpha$ defines an angle of about 11.8 degrees out of the page about the X axis. In FIG. 5, the angle defines an angle of about 3.5 degrees about the Y axis, into the page. Further, the angle in FIG. 6 defines an angle of about 40.2 degrees about the Z axis, into the page.

With the new coordinate system, sections 1-12, as illustrated in FIG. 2 can be taken directly along the Z axis and points can be populated around these sections. These points as previously stated are defined in the X and Y component with distance dimensions. The dimensions are now referenced from the new relative coordinate system. The Z component is non-dimensionalized. The value of Z' found in the Table is multiplied by the span or the airfoil height dimension.

In this case, a first stage bucket airfoil, as embodied by the invention, has a span of about 6.889", as embodied by the invention. Once the distance Z dimension is determined, it is then added to the root radius of the turbine bucket airfoil 10 to give an actual Z distance from the rotational axis, for the first stage bucket the root radius is about 40.216".

Figure 8:
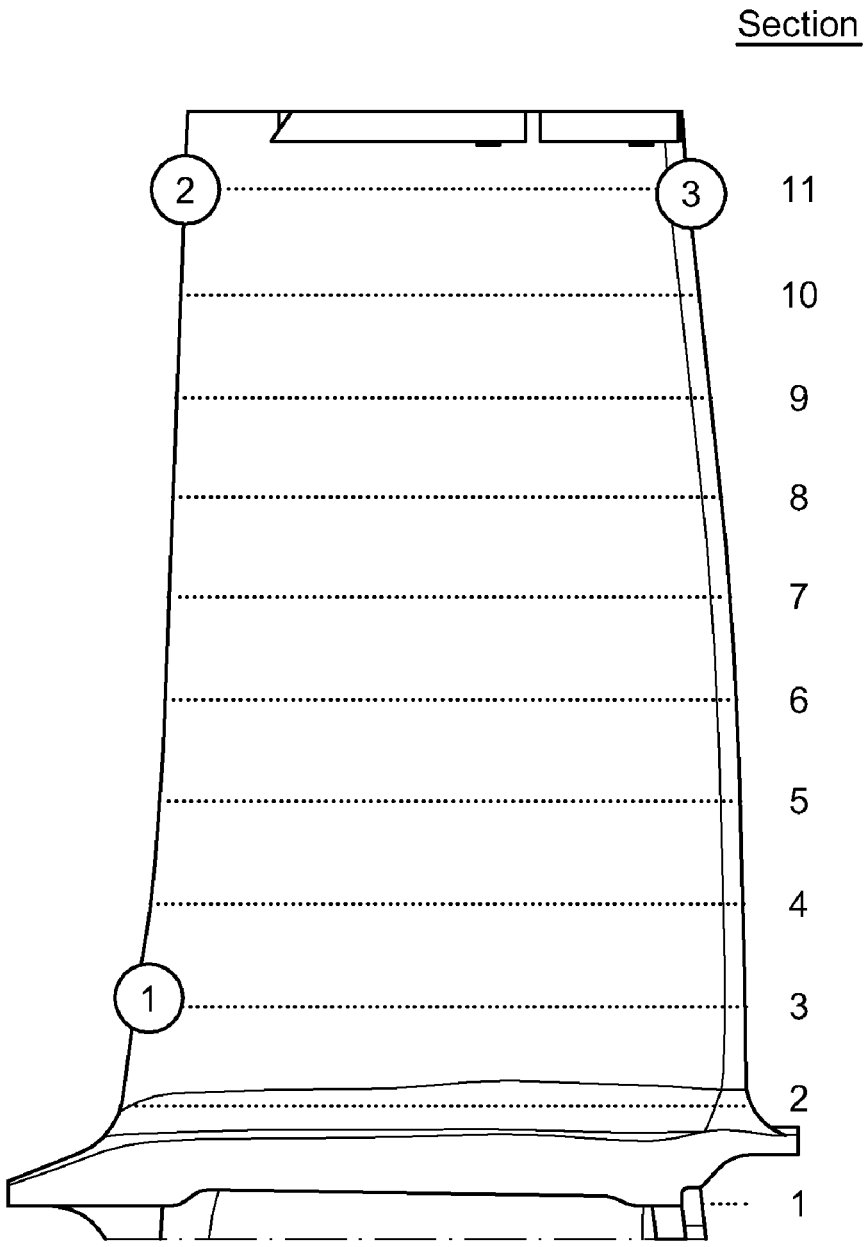
FIG. 8 is a front isometric illustration of the bucket airfoil, as embodied by the invention, showing the sections of points from base to tip of the airfoil.

There are twelve sections of points for the exemplary turbine bucket airfoil, as embodied by the invention, from the root of the turbine bucket airfoil 10 to the tip as shown in FIG. 8. Each respective section contains 146 points; these points are defined in the Table. They are referenced from the coordinate system that is based on the turbine bucket airfoil 10 geometry. Each of these sections defines areas of essentially constant radius in the turbine bucket airfoil 10, as embodied by the invention.

The flow path that includes the turbine bucket airfoil, as embodied by the invention, comprises any number of rotor stages and stator stages, for example seventeen stages. However, the exact number of rotor and stator stages is a choice of engineering design. Any number of rotor and stator stages can be provided, as embodied by the invention. The seventeen stages are merely exemplary of one turbine design. The number of stages is not intended to limit the invention in any manner.

To define the turbine bucket airfoil, a unique set or loci of points in space are provided. This unique set or loci of points are defined in the Table and meet the stage requirements so the stage can be manufactured. This unique loci of points also meets requirements for stage efficiency and reduced thermal and mechanical stresses. The loci of points are arrived at by iteration between aerodynamic and mechanical loadings enabling operation in an efficient, safe, and smooth manner. The loci, as embodied by the invention, defines the rotor bucket airfoil profile and can comprise a set of points relative to the axis of rotation of the engine.

The X and Y coordinates, and their values (described hereinafter) are given in distance dimensions, where the Z coordinate is in a normalized form. These coordinates, however, are based on a system relative to the engine coordinate system. Moreover, the coordinates however, are based on a system relative to the engine coordinate system.

The engine coordinate system is defined having the X axis in engine an axial engine direction, the Y axis in a circumferential direction, and the Z axis in the radial (outward) engine direction from the engine centerline as shown in FIG. 1. The coordinate system that defines the profile however, is based on its own geometry and is relative to the aforementioned engine coordinate system. This relative coordinate system, as embodied by the invention, is based on a reference plane (FIG. 2) defined by three points located on the bucket airfoil.

A Cartesian coordinate system of X, Y and Z values given in the Table below defines a profile of a rotor bucket airfoil at various locations along its length. The coordinate values for the X, Y and Z coordinates are set forth in inches, although other units of dimensions may be used when the values are appropriately converted. These values exclude fillet regions of the platform. By connecting the X and Y values with smooth continuing arcs, each profile section at each distance Z can be fixed. The airfoil profiles of the various surface locations between the distances Z are determined by smoothly connecting the adjacent profile sections to one another, thus forming the airfoil profile. These values represent the airfoil profiles at ambient, non-operating, or non-hot conditions and are for an uncoated airfoil.

The Table values are generated and shown to four decimal places for determining the profile of the airfoil. There are typical manufacturing tolerances as well as coatings, which should be accounted for in the actual profile of the airfoil. Accordingly, the values for the profile given are for a nominal airfoil. It will therefore be appreciated that +/− typical manufacturing tolerances, such as, +/− values, including any coating thicknesses, are additive to the X and Y values. Therefore, a distance of about +/−0.160 inches in a direction normal to any surface location along the airfoil profile defines an airfoil profile envelope for a rotor bucket airfoil design. In other words, a distance of about +/−0.160 inches in a direction normal to any surface location along the airfoil profile defines a range of variation between measured points on the actual airfoil surface at nominal cold or room temperature and the ideal position of those points, at the same temperature, as embodied by the invention. The rotor bucket airfoil design, as embodied by the invention, is robust to this range of variation without impairment of mechanical and aerodynamic functions.

The coordinate values given in TABLE below provide the nominal profile envelope for an exemplary first stage bucket. The first stage bucket can be utilized in a gas turbine, such as, but not limited to, a 7FA+e gas turbine engine produced by General Electric of Schenectady, N.Y.

TABLE 1

| Point Coordinates | | | | | | | | |
|---|---|---|---|---|---|---|---|---|
| Section 1 | | | Section 2 | | | Section 3 | | |
| X | Y | Z' | X | Y | Z' | X | Y | Z' |
| 3.9801 | 1.0551 | −0.9511 | 4.0316 | 0.9404 | −0.8661 | 4.0796 | 0.8205 | −0.7762 |
| 4.0066 | 1.0709 | −0.9510 | 4.0577 | 0.9555 | −0.8660 | 4.1052 | 0.8351 | −0.7761 |
| 3.9499 | 1.0486 | −0.9510 | 4.0021 | 0.9346 | −0.8659 | 4.0507 | 0.8154 | −0.7760 |
| 4.0267 | 1.0941 | −0.9506 | 4.0772 | 0.9782 | −0.8656 | 4.1242 | 0.8573 | −0.7756 |
| 3.9193 | 1.0517 | −0.9505 | 3.9723 | 0.9381 | −0.8655 | 4.0217 | 0.8194 | −0.7755 |
| 4.0360 | 1.1164 | −0.9500 | 4.0858 | 0.9995 | −0.8651 | 4.1321 | 0.8777 | −0.7751 |
| 3.8899 | 1.0606 | −0.9499 | 3.9438 | 0.9472 | −0.8649 | 3.9940 | 0.8288 | −0.7749 |
| 4.0387 | 1.1402 | −0.9494 | 4.0880 | 1.0223 | −0.8644 | 4.1339 | 0.8994 | −0.7745 |
| 3.8617 | 1.0727 | −0.9492 | 3.9163 | 0.9590 | −0.8642 | 3.9671 | 0.8403 | −0.7743 |
| 4.0354 | 1.1639 | −0.9487 | 4.0846 | 1.0448 | −0.8637 | 4.1302 | 0.9207 | −0.7739 |
| 3.8341 | 1.0860 | −0.9485 | 3.8893 | 0.9719 | −0.8635 | 3.9406 | 0.8527 | −0.7736 |
| 4.0267 | 1.1861 | −0.9479 | 4.0759 | 1.0659 | −0.8630 | 4.1213 | 0.9405 | −0.7732 |
| 3.8069 | 1.0999 | −0.9478 | 3.8626 | 0.9852 | −0.8629 | 3.9144 | 0.8655 | −0.7729 |
| 4.0130 | 1.2057 | −0.9472 | 4.0624 | 1.0842 | −0.8624 | 4.1080 | 0.9577 | −0.7726 |
| 3.9958 | 1.2224 | −0.9465 | 4.0455 | 1.0998 | −0.8617 | 4.0919 | 0.9724 | −0.7720 |
| 3.9766 | 1.2369 | −0.9459 | 4.0270 | 1.1132 | −0.8611 | 4.0742 | 0.9851 | −0.7714 |
| 3.7238 | 1.1419 | −0.9456 | 3.7812 | 1.0255 | −0.8607 | 3.8345 | 0.9041 | −0.7709 |
| 3.9565 | 1.2502 | −0.9453 | 4.0076 | 1.1257 | −0.8605 | 4.0556 | 0.9967 | −0.7708 |
| 3.6400 | 1.1825 | −0.9435 | 3.6992 | 1.0646 | −0.8586 | 3.9902 | 1.0356 | −0.7689 |
| 3.8909 | 1.2923 | −0.9433 | 3.9424 | 1.1666 | −0.8586 | 3.7540 | 0.9415 | −0.7689 |
| 3.5555 | 1.2216 | −0.9414 | 3.8768 | 1.2070 | −0.8566 | 3.9249 | 1.0746 | −0.7670 |
| 3.8250 | 1.3340 | −0.9413 | 3.6165 | 1.1023 | −0.8566 | 3.6731 | 0.9782 | −0.7669 |
| 3.7589 | 1.3754 | −0.9393 | 3.8110 | 1.2470 | −0.8547 | 3.8596 | 1.1135 | −0.7652 |
| 3.4702 | 1.2593 | −0.9393 | 3.5332 | 1.1388 | −0.8546 | 3.5915 | 1.0135 | −0.7649 |
| 0.0434 | −0.0940 | −0.9379 | 3.7451 | 1.2868 | −0.8528 | 3.7942 | 1.1523 | −0.7633 |
| 3.6925 | 1.4164 | −0.9374 | 3.4493 | 1.1739 | −0.8526 | 3.5094 | 1.0475 | −0.7629 |
| 0.1230 | −0.0441 | −0.9374 | 3.6789 | 1.3263 | −0.8509 | 3.7287 | 1.1909 | −0.7614 |
| 3.3843 | 1.2954 | −0.9372 | 3.3649 | 1.2078 | −0.8506 | 3.4268 | 1.0804 | −0.7610 |
| −0.0488 | −0.1032 | −0.9370 | 0.1338 | −0.0663 | −0.8492 | 3.6631 | 1.2293 | −0.7595 |
| 0.1946 | 0.0169 | −0.9365 | 3.6127 | 1.3657 | −0.8490 | 3.3437 | 1.1121 | −0.7591 |
| 3.6260 | 1.4571 | −0.9354 | 3.2800 | 1.2405 | −0.8486 | 3.5973 | 1.2675 | −0.7576 |
| 0.2591 | 0.0851 | −0.9352 | 0.0446 | −0.0822 | −0.8486 | 3.2602 | 1.1425 | −0.7573 |
| 3.2978 | 1.3303 | −0.9352 | 0.2089 | −0.0139 | −0.8486 | 3.5313 | 1.3054 | −0.7558 |
| −0.1163 | −0.0664 | −0.9352 | 0.2713 | 0.0530 | −0.8474 | 0.2207 | −0.0430 | −0.7556 |
| 0.3176 | 0.1584 | −0.9338 | 3.5464 | 1.4048 | −0.8471 | 3.1761 | 1.1717 | −0.7554 |
| 3.5593 | 1.4975 | −0.9335 | −0.0266 | −0.0541 | −0.8470 | 0.1343 | −0.0644 | −0.7552 |
| 3.2107 | 1.3639 | −0.9332 | 3.1946 | 1.2720 | −0.8467 | 0.2897 | 0.0134 | −0.7548 |
| −0.1532 | 0.0009 | −0.9328 | 0.3271 | 0.1255 | −0.8460 | 3.4651 | 1.3428 | −0.7539 |
| 0.3732 | 0.2338 | −0.9323 | 3.4798 | 1.4436 | −0.8452 | 0.0608 | −0.0463 | −0.7538 |
| 3.4924 | 1.5377 | −0.9315 | 3.1086 | 1.3020 | −0.8449 | 3.0915 | 1.1995 | −0.7536 |
| 3.1232 | 1.3961 | −0.9312 | −0.0734 | 0.0055 | −0.8447 | 0.3436 | 0.0846 | −0.7534 |
| 0.4270 | 0.3105 | −0.9307 | 0.3789 | 0.2007 | −0.8444 | 3.3984 | 1.3794 | −0.7521 |
| −0.1735 | 0.0756 | −0.9304 | 3.4130 | 1.4820 | −0.8433 | 3.0064 | 1.2258 | −0.7519 |
| 3.4253 | 1.5774 | −0.9296 | 3.0221 | 1.3306 | −0.8430 | 0.3930 | 0.1589 | −0.7518 |
| 3.0350 | 1.4269 | −0.9293 | 0.4284 | 0.2774 | −0.8428 | 0.0050 | 0.0040 | −0.7517 |
| 0.4794 | 0.3881 | −0.9291 | −0.1016 | 0.0765 | −0.8423 | 3.3313 | 1.4154 | −0.7502 |
| −0.1896 | 0.1513 | −0.9281 | 3.3458 | 1.5198 | −0.8414 | 2.9208 | 1.2503 | −0.7502 |
| 3.3579 | 1.6166 | −0.9277 | 2.9350 | 1.3574 | −0.8412 | 0.4378 | 0.2359 | −0.7501 |
| 0.5309 | 0.4663 | −0.9275 | 0.4772 | 0.3546 | −0.8411 | −0.0311 | 0.0701 | −0.7494 |
| 2.9463 | 1.4561 | −0.9274 | −0.1236 | 0.1496 | −0.8400 | 2.8345 | 1.2729 | −0.7485 |
| 0.5820 | 0.5448 | −0.9258 | 3.2783 | 1.5569 | −0.8395 | 3.2639 | 1.4507 | −0.7484 |
| 3.2901 | 1.6553 | −0.9258 | 0.5260 | 0.4317 | −0.8395 | 0.4813 | 0.3137 | −0.7484 |

TABLE 1-continued

| Point Coordinates | | | | | | | | |
|---|---|---|---|---|---|---|---|---|
| −0.1996 | 0.2282 | −0.9257 | 2.8472 | 1.3823 | −0.8395 | −0.0597 | 0.1399 | −0.7470 |
| 2.8569 | 1.4834 | −0.9256 | 0.5753 | 0.5085 | −0.8379 | 2.7477 | 1.2934 | −0.7469 |
| 0.6329 | 0.6233 | −0.9242 | 2.7589 | 1.4052 | −0.8378 | 0.5260 | 0.3908 | −0.7467 |
| 3.2219 | 1.6934 | −0.9239 | 3.2103 | 1.5933 | −0.8377 | 3.1960 | 1.4853 | −0.7466 |
| 2.7669 | 1.5087 | −0.9238 | −0.1405 | 0.2242 | −0.8376 | 2.6604 | 1.3116 | −0.7453 |
| −0.2060 | 0.3055 | −0.9234 | 0.6256 | 0.5847 | −0.8363 | 0.5726 | 0.4669 | −0.7451 |
| 0.6843 | 0.7015 | −0.9225 | 2.6700 | 1.4258 | −0.8361 | 3.1278 | 1.5192 | −0.7449 |
| 2.6763 | 1.5318 | −0.9221 | 3.1420 | 1.6291 | −0.8358 | −0.0824 | 0.2118 | −0.7447 |
| 3.1534 | 1.7308 | −0.9220 | −0.1527 | 0.2997 | −0.8353 | 2.5725 | 1.3274 | −0.7438 |
| −0.2094 | 0.3830 | −0.9212 | 0.6772 | 0.6601 | −0.8347 | 0.6209 | 0.5418 | −0.7435 |
| 0.7364 | 0.7793 | −0.9209 | 2.5805 | 1.4439 | −0.8346 | 3.0593 | 1.5525 | −0.7431 |
| 2.5850 | 1.5525 | −0.9204 | 3.0733 | 1.6642 | −0.8340 | 2.4841 | 1.3405 | −0.7424 |
| 3.0845 | 1.7675 | −0.9201 | 0.7306 | 0.7343 | −0.8332 | −0.0996 | 0.2853 | −0.7424 |
| 0.7898 | 0.8562 | −0.9193 | 2.4904 | 1.4592 | −0.8331 | 0.6716 | 0.6153 | −0.7420 |
| −0.2101 | 0.4606 | −0.9189 | −0.1609 | 0.3758 | −0.8330 | 2.9904 | 1.5851 | −0.7414 |
| 2.4931 | 1.5704 | −0.9188 | 3.0042 | 1.6986 | −0.8322 | 2.3953 | 1.3509 | −0.7411 |
| 3.0152 | 1.8036 | −0.9182 | 0.7862 | 0.8069 | −0.8318 | 0.7249 | 0.6870 | −0.7405 |
| 0.8450 | 0.9320 | −0.9178 | 2.3998 | 1.4716 | −0.8316 | −0.1122 | 0.3597 | −0.7401 |
| 2.4006 | 1.5852 | −0.9173 | −0.1654 | 0.4523 | −0.8308 | 2.3062 | 1.3583 | −0.7398 |
| −0.2083 | 0.5382 | −0.9167 | 2.9348 | 1.7323 | −0.8304 | 2.9213 | 1.6171 | −0.7396 |
| 2.9456 | 1.8391 | −0.9164 | 0.8441 | 0.8777 | −0.8304 | 0.7810 | 0.7565 | −0.7392 |
| 0.9023 | 1.0061 | −0.9163 | 2.3087 | 1.4807 | −0.8303 | 2.2168 | 1.3626 | −0.7386 |
| 2.3075 | 1.5964 | −0.9159 | 0.9047 | 0.9464 | −0.8291 | 0.8404 | 0.8235 | −0.7380 |
| 0.9624 | 1.0782 | −0.9150 | 2.2173 | 1.4862 | −0.8291 | 2.8518 | 1.6484 | −0.7379 |
| 2.8757 | 1.8739 | −0.9146 | 2.8651 | 1.7654 | −0.8287 | −0.1207 | 0.4348 | −0.7378 |
| 2.2139 | 1.6037 | −0.9146 | −0.1666 | 0.5289 | −0.8285 | 2.1272 | 1.3635 | −0.7376 |
| −0.2043 | 0.6158 | −0.9145 | 0.9682 | 1.0125 | −0.8280 | 0.9031 | 0.8874 | −0.7369 |
| 1.0255 | 1.1478 | −0.9137 | 2.1257 | 1.4879 | −0.8279 | 2.0376 | 1.3608 | −0.7366 |
| 2.1200 | 1.6067 | −0.9134 | 1.0347 | 1.0756 | −0.8270 | 2.7820 | 1.6791 | −0.7362 |
| 2.8054 | 1.9081 | −0.9128 | 2.0340 | 1.4856 | −0.8269 | 0.9693 | 0.9479 | −0.7359 |
| 1.0920 | 1.2141 | −0.9126 | 2.7950 | 1.7978 | −0.8269 | 1.9482 | 1.3544 | −0.7357 |
| −0.1980 | 0.6933 | −0.9124 | −0.1652 | 0.6056 | −0.8264 | −0.1254 | 0.5102 | −0.7356 |
| 2.0260 | 1.6051 | −0.9123 | 1.1043 | 1.1354 | −0.8261 | 1.0385 | 1.0049 | −0.7351 |
| 1.1621 | 1.2768 | −0.9116 | 1.9425 | 1.4789 | −0.8260 | 1.8591 | 1.3441 | −0.7350 |
| 1.9322 | 1.5985 | −0.9114 | 1.1772 | 1.1912 | −0.8253 | 2.7119 | 1.7092 | −0.7345 |
| 2.7348 | 1.9416 | −0.9110 | 1.8513 | 1.4675 | −0.8253 | 1.1108 | 1.0580 | −0.7344 |
| 1.2359 | 1.3352 | −0.9108 | 2.7246 | 1.8295 | −0.8252 | 1.7705 | 1.3297 | −0.7343 |
| 1.8388 | 1.5866 | −0.9106 | 1.2532 | 1.2428 | −0.8247 | 1.1860 | 1.1072 | −0.7339 |
| −0.1897 | 0.7706 | −0.9102 | 1.7609 | 1.4512 | −0.8247 | 1.6826 | 1.3111 | −0.7338 |
| 1.3134 | 1.3887 | −0.9102 | 1.3322 | 1.2899 | −0.8243 | 1.2637 | 1.1522 | −0.7335 |
| 1.7463 | 1.5689 | −0.9101 | 1.6716 | 1.4295 | −0.8243 | 1.5957 | 1.2882 | −0.7335 |
| 1.3944 | 1.4369 | −0.9097 | −0.1613 | 0.6822 | −0.8242 | −0.1269 | 0.5859 | −0.7334 |
| 1.6550 | 1.5453 | −0.9097 | 1.4138 | 1.3323 | −0.8240 | 1.5102 | 1.2608 | −0.7333 |
| 1.4786 | 1.4792 | −0.9095 | 1.5838 | 1.4023 | −0.8240 | 1.3438 | 1.1929 | −0.7333 |
| 1.5656 | 1.5155 | −0.9095 | 1.4977 | 1.3699 | −0.8239 | 1.4261 | 1.2291 | −0.7332 |
| 2.6638 | 1.9745 | −0.9092 | 2.6539 | 1.8606 | −0.8234 | 2.6415 | 1.7385 | −0.7328 |
| −0.1793 | 0.8477 | −0.9081 | −0.1550 | 0.7587 | −0.8221 | −0.1255 | 0.6616 | −0.7312 |
| 2.5926 | 2.0068 | −0.9074 | 2.5828 | 1.8910 | −0.8217 | 2.5707 | 1.7670 | −0.7312 |
| −0.1666 | 0.9245 | −0.9061 | 2.5115 | 1.9207 | −0.8200 | 2.4996 | 1.7947 | −0.7295 |
| 2.5210 | 2.0383 | −0.9057 | −0.1463 | 0.8350 | −0.8200 | −0.1212 | 0.7372 | −0.7291 |
| −0.1518 | 1.0010 | −0.9041 | 2.4398 | 1.9496 | −0.8184 | 2.4282 | 1.8216 | −0.7279 |
| 2.4491 | 2.0692 | −0.9039 | −0.1351 | 0.9110 | −0.8179 | −0.1140 | 0.8126 | −0.7270 |
| 2.3768 | 2.0991 | −0.9022 | 2.3677 | 1.9776 | −0.8167 | 2.3564 | 1.8477 | −0.7263 |
| −0.1347 | 1.0771 | −0.9021 | −0.1214 | 0.9867 | −0.8159 | −0.1039 | 0.8878 | −0.7250 |
| 2.3041 | 2.1282 | −0.9005 | 2.2953 | 2.0046 | −0.8151 | 2.2843 | 1.8728 | −0.7248 |
| −0.1154 | 1.1526 | −0.9001 | −0.1051 | 1.0619 | −0.8139 | 2.2118 | 1.8970 | −0.7232 |
| 2.2310 | 2.1562 | −0.8989 | 2.2224 | 2.0307 | −0.8135 | −0.0909 | 0.9626 | −0.7230 |
| −0.0938 | 1.2276 | −0.8982 | −0.0862 | 1.1366 | −0.8120 | 2.1390 | 1.9202 | −0.7217 |
| 2.1574 | 2.1831 | −0.8972 | 2.1492 | 2.0557 | −0.8119 | −0.0749 | 1.0368 | −0.7210 |
| −0.0698 | 1.3020 | −0.8964 | 2.0755 | 2.0795 | −0.8103 | 2.0658 | 1.9424 | −0.7202 |
| 2.0834 | 2.2087 | −0.8956 | −0.0646 | 1.2105 | −0.8101 | −0.0558 | 1.1104 | −0.7191 |
| −0.0436 | 1.3756 | −0.8946 | 2.0015 | 2.1021 | −0.8088 | 1.9923 | 1.9636 | −0.7187 |
| 2.0088 | 2.2329 | −0.8940 | −0.0403 | 1.2838 | −0.8083 | −0.0337 | 1.1832 | −0.7173 |
| −0.0149 | 1.4483 | −0.8928 | 1.9270 | 2.1233 | −0.8073 | 1.9185 | 1.9836 | −0.7173 |
| 1.9338 | 2.2557 | −0.8925 | −0.0133 | 1.3561 | −0.8065 | 1.8443 | 2.0023 | −0.7159 |
| 0.0163 | 1.5201 | −0.8911 | 1.8521 | 2.1432 | −0.8059 | −0.0085 | 1.2551 | −0.7155 |
| 1.8582 | 2.2769 | −0.8910 | 0.0165 | 1.4274 | −0.8048 | 1.7697 | 2.0196 | −0.7145 |
| 1.7822 | 2.2964 | −0.8896 | 1.7767 | 2.1615 | −0.8044 | 0.0199 | 1.3259 | −0.7138 |
| 0.0501 | 1.5908 | −0.8895 | 0.0492 | 1.4974 | −0.8032 | 1.6947 | 2.0353 | −0.7131 |
| 1.7056 | 2.3140 | −0.8881 | 1.7009 | 2.1781 | −0.8031 | 0.0514 | 1.3954 | −0.7122 |
| 0.0868 | 1.6601 | −0.8879 | 1.6247 | 2.1927 | −0.8018 | 1.6194 | 2.0492 | −0.7119 |
| 1.6286 | 2.3294 | −0.8868 | 0.0851 | 1.5660 | −0.8017 | 0.0864 | 1.4633 | −0.7107 |
| 0.1264 | 1.7279 | −0.8864 | 1.5480 | 2.2052 | −0.8005 | 1.5437 | 2.0613 | −0.7106 |
| 1.5510 | 2.3424 | −0.8855 | 0.1242 | 1.6329 | −0.8002 | 1.4676 | 2.0713 | −0.7094 |
| 0.1690 | 1.7938 | −0.8850 | 1.4710 | 2.2154 | −0.7993 | 0.1249 | 1.5294 | −0.7092 |
| 1.4730 | 2.3527 | −0.8843 | 0.1667 | 1.6978 | −0.7988 | 1.3913 | 2.0791 | −0.7083 |
| 0.2148 | 1.8577 | −0.8837 | 1.3936 | 2.2229 | −0.7982 | 0.1671 | 1.5933 | −0.7079 |
| 1.3946 | 2.3602 | −0.8832 | 0.2128 | 1.7603 | −0.7976 | 1.3147 | 2.0846 | −0.7073 |

TABLE 1-continued

| Point Coordinates | | | | | | | | |
|---|---|---|---|---|---|---|---|---|
| 0.2639 | 1.9193 | −0.8825 | 1.3159 | 2.2276 | −0.7971 | 0.2130 | 1.6547 | −0.7067 |
| 1.3159 | 2.3644 | −0.8821 | 0.2625 | 1.8201 | −0.7964 | 1.2379 | 2.0873 | −0.7063 |
| 0.3164 | 1.9780 | −0.8815 | 1.2381 | 2.2293 | −0.7962 | 0.2628 | 1.7131 | −0.7056 |
| 1.2370 | 2.3652 | −0.8812 | 0.3157 | 1.8769 | −0.7954 | 1.1610 | 2.0872 | −0.7054 |
| 0.3723 | 2.0337 | −0.8805 | 1.1602 | 2.2276 | −0.7953 | 0.3166 | 1.7680 | −0.7046 |
| 1.1582 | 2.3623 | −0.8803 | 0.3725 | 1.9303 | −0.7946 | 1.0841 | 2.0838 | −0.7046 |
| 0.4316 | 2.0857 | −0.8797 | 1.0824 | 2.2223 | −0.7945 | 1.0075 | 2.0769 | −0.7039 |
| 1.0795 | 2.3553 | −0.8796 | 1.0049 | 2.2132 | −0.7939 | 0.3740 | 1.8192 | −0.7038 |
| 0.4942 | 2.1340 | −0.8791 | 0.4327 | 1.9798 | −0.7939 | 0.9312 | 2.0661 | −0.7033 |
| 1.0013 | 2.3440 | −0.8790 | 0.9280 | 2.2001 | −0.7933 | 0.4348 | 1.8664 | −0.7032 |
| 0.5598 | 2.1781 | −0.8786 | 0.4963 | 2.0250 | −0.7933 | 0.8556 | 2.0512 | −0.7028 |
| 0.9238 | 2.3283 | −0.8785 | 0.8519 | 2.1826 | −0.7930 | 0.4989 | 1.9092 | −0.7027 |
| 0.6282 | 2.2178 | −0.8782 | 0.5629 | 2.0658 | −0.7929 | 0.7809 | 2.0321 | −0.7025 |
| 0.8474 | 2.3080 | −0.8782 | 0.7769 | 2.1605 | −0.7927 | 0.5660 | 1.9472 | −0.7024 |
| 0.6991 | 2.2528 | −0.8781 | 0.6321 | 2.1020 | −0.7927 | 0.7075 | 2.0085 | −0.7023 |
| 0.7723 | 2.2829 | −0.8781 | 0.7036 | 2.1336 | −0.7926 | 0.6357 | 1.9802 | −0.7023 |

| Section 4 | | | Section 5 | | | Section 6 | | |
|---|---|---|---|---|---|---|---|---|
| X | Y | Z' | X | Y | Z' | X | Y | Z' |
| 4.1124 | 0.7046 | −0.6859 | 4.1302 | 0.5967 | −0.5953 | 4.1334 | 0.4926 | −0.5043 |
| 4.1377 | 0.7186 | −0.6858 | 4.1552 | 0.6103 | −0.5952 | 4.1582 | 0.5059 | −0.5042 |
| 4.0838 | 0.7001 | −0.6857 | 4.1020 | 0.5926 | −0.5951 | 4.1056 | 0.4889 | −0.5041 |
| 4.1564 | 0.7405 | −0.6854 | 4.1735 | 0.6320 | −0.5948 | 4.1760 | 0.5273 | −0.5038 |
| 4.0554 | 0.7045 | −0.6853 | 4.0739 | 0.5974 | −0.5946 | 4.0780 | 0.4938 | −0.5036 |
| 4.1638 | 0.7607 | −0.6849 | 4.1804 | 0.6521 | −0.5943 | 4.1825 | 0.5471 | −0.5033 |
| 4.0282 | 0.7140 | −0.6847 | 4.0473 | 0.6072 | −0.5940 | 4.0517 | 0.5033 | −0.5031 |
| 4.1650 | 0.7821 | −0.6843 | 4.1810 | 0.6732 | −0.5937 | 4.1827 | 0.5677 | −0.5028 |
| 4.0018 | 0.7254 | −0.6840 | 4.0212 | 0.6185 | −0.5934 | 4.0260 | 0.5141 | −0.5025 |
| 4.1605 | 0.8030 | −0.6837 | 4.1759 | 0.6936 | −0.5930 | 4.1772 | 0.5876 | −0.5021 |
| 3.9757 | 0.7374 | −0.6834 | 3.9954 | 0.6302 | −0.5927 | 4.0004 | 0.5254 | −0.5018 |
| 4.1510 | 0.8222 | −0.6830 | 4.1658 | 0.7121 | −0.5924 | 4.1668 | 0.6054 | −0.5015 |
| 3.9498 | 0.7498 | −0.6827 | 3.9697 | 0.6422 | −0.5921 | 3.9750 | 0.5370 | −0.5012 |
| 4.1371 | 0.8385 | −0.6824 | 4.1515 | 0.7276 | −0.5918 | 4.1524 | 0.6203 | −0.5009 |
| 4.1206 | 0.8523 | −0.6818 | 4.1348 | 0.7407 | −0.5912 | 4.1358 | 0.6327 | −0.5003 |
| 4.1027 | 0.8643 | −0.6812 | 4.1169 | 0.7521 | −0.5906 | 4.1180 | 0.6435 | −0.4998 |
| 3.8708 | 0.7870 | −0.6807 | 4.0983 | 0.7624 | −0.5901 | 4.0996 | 0.6534 | −0.4993 |
| 4.0840 | 0.8753 | −0.6807 | 3.8912 | 0.6780 | −0.5901 | 3.8975 | 0.5715 | −0.4993 |
| 4.0191 | 0.9127 | −0.6788 | 4.0337 | 0.7983 | −0.5883 | 4.0359 | 0.6877 | −0.4976 |
| 3.7913 | 0.8232 | −0.6787 | 3.8124 | 0.7130 | −0.5882 | 3.8196 | 0.6052 | −0.4974 |
| 3.9542 | 0.9503 | −0.6770 | 3.9693 | 0.8345 | −0.5865 | 3.9723 | 0.7222 | −0.4958 |
| 3.7115 | 0.8587 | −0.6768 | 3.7333 | 0.7474 | −0.5863 | 3.7413 | 0.6382 | −0.4955 |
| 3.8893 | 0.9880 | −0.6751 | 3.9050 | 0.8708 | −0.5847 | 3.9088 | 0.7569 | −0.4941 |
| 3.6311 | 0.8929 | −0.6748 | 3.6536 | 0.7805 | −0.5844 | 3.6625 | 0.6700 | −0.4937 |
| 3.8244 | 1.0257 | −0.6733 | 3.8406 | 0.9071 | −0.5829 | 3.8453 | 0.7916 | −0.4923 |
| 3.5502 | 0.9259 | −0.6729 | 3.5734 | 0.8124 | −0.5825 | 3.5833 | 0.7006 | −0.4919 |
| 3.7595 | 1.0632 | −0.6715 | 3.7762 | 0.9433 | −0.5811 | 3.7817 | 0.8262 | −0.4906 |
| 3.4688 | 0.9578 | −0.6711 | 3.4928 | 0.8433 | −0.5807 | 3.5036 | 0.7301 | −0.4901 |
| 3.6944 | 1.1005 | −0.6696 | 3.7117 | 0.9793 | −0.5793 | 3.7180 | 0.8607 | −0.4889 |
| 3.3869 | 0.9885 | −0.6692 | 3.4117 | 0.8730 | −0.5789 | 3.4235 | 0.7586 | −0.4883 |
| 3.6293 | 1.1376 | −0.6678 | 3.6471 | 1.0152 | −0.5775 | 3.6543 | 0.8950 | −0.4871 |
| 3.3045 | 1.0181 | −0.6674 | 3.3301 | 0.9016 | −0.5771 | 3.3430 | 0.7861 | −0.4866 |
| 3.5639 | 1.1745 | −0.6660 | 3.5823 | 1.0507 | −0.5758 | 3.5905 | 0.9291 | −0.4854 |
| 3.2217 | 1.0464 | −0.6656 | 3.2482 | 0.9290 | −0.5753 | 3.2621 | 0.8124 | −0.4849 |
| 3.4982 | 1.2107 | −0.6641 | 3.5173 | 1.0858 | −0.5740 | 3.5264 | 0.9628 | −0.4837 |
| 3.1385 | 1.0735 | −0.6638 | 3.1658 | 0.9553 | −0.5736 | 3.1808 | 0.8377 | −0.4832 |
| 0.2898 | −0.0522 | −0.6627 | 3.4519 | 1.1202 | −0.5722 | 3.4620 | 0.9959 | −0.4820 |
| 0.2053 | −0.0756 | −0.6624 | 3.0830 | 0.9802 | −0.5719 | 3.0992 | 0.8618 | −0.4815 |
| 3.4321 | 1.2463 | −0.6623 | 3.3861 | 1.1539 | −0.5705 | 3.3972 | 1.0282 | −0.4803 |
| 3.0547 | 1.0991 | −0.6621 | 0.3416 | −0.0889 | −0.5704 | 3.0171 | 0.8846 | −0.4799 |
| 0.3573 | 0.0037 | −0.6619 | 2.9997 | 1.0036 | −0.5703 | 3.3320 | 1.0600 | −0.4786 |
| 0.1316 | −0.0625 | −0.6611 | 0.2577 | −0.1106 | −0.5700 | 2.9346 | 0.9058 | −0.4783 |
| 3.3656 | 1.2812 | −0.6605 | 0.4135 | −0.0405 | −0.5698 | 0.3723 | −0.1181 | −0.4776 |
| 2.9704 | 1.1231 | −0.6604 | 0.1850 | −0.0977 | −0.5688 | 0.4466 | −0.0759 | −0.4773 |
| 0.4067 | 0.0761 | −0.6604 | 3.3199 | 1.1869 | −0.5687 | 0.2891 | −0.1367 | −0.4772 |
| 0.0722 | −0.0180 | −0.6592 | 2.9159 | 1.0253 | −0.5686 | 3.2666 | 1.0910 | −0.4769 |
| 2.8856 | 1.1452 | −0.6588 | 0.4641 | 0.0296 | −0.5684 | 2.8516 | 0.9254 | −0.4768 |
| 3.2987 | 1.3153 | −0.6588 | 2.8316 | 1.0452 | −0.5671 | 0.4995 | −0.0092 | −0.4760 |
| 0.4504 | 0.1520 | −0.6587 | 3.2533 | 1.2193 | −0.5670 | 0.2181 | −0.1229 | −0.4759 |
| 2.8003 | 1.1654 | −0.6572 | 0.1257 | −0.0549 | −0.5669 | 2.7683 | 0.9433 | −0.4753 |
| 3.2315 | 1.3488 | −0.6570 | 0.5055 | 0.1055 | −0.5667 | 3.2008 | 1.1215 | −0.4753 |
| 0.4896 | 0.2303 | −0.6569 | 2.7468 | 1.0632 | −0.5656 | 0.5404 | 0.0654 | −0.4743 |
| 0.0316 | 0.0442 | −0.6569 | 3.1865 | 1.2510 | −0.5653 | 0.1592 | −0.0820 | −0.4741 |
| 2.7144 | 1.1835 | −0.6557 | 0.5414 | 0.1840 | −0.5649 | 2.6845 | 0.9595 | −0.4738 |
| 3.1639 | 1.3816 | −0.6553 | 0.0839 | 0.0052 | −0.5647 | 3.1348 | 1.1514 | −0.4736 |
| 0.5278 | 0.3090 | −0.6551 | 2.6617 | 1.0793 | −0.5641 | 0.5756 | 0.1427 | −0.4725 |
| −0.0009 | 0.1111 | −0.6546 | 3.1193 | 1.2820 | −0.5637 | 2.6004 | 0.9739 | −0.4724 |

TABLE 1-continued

| Point Coordinates | | | | | | | | |
|---|---|---|---|---|---|---|---|---|
| 2.6280 | 1.1994 | −0.6542 | 0.5756 | 0.2633 | −0.5630 | 3.0684 | 1.1806 | −0.4720 |
| 3.0960 | 1.4137 | −0.6536 | 2.5761 | 1.0933 | −0.5627 | 0.1168 | −0.0242 | −0.4719 |
| 0.5682 | 0.3867 | −0.6533 | 0.0501 | 0.0702 | −0.5624 | 2.5160 | 0.9864 | −0.4711 |
| 2.5413 | 1.2130 | −0.6528 | 3.0518 | 1.3124 | −0.5620 | 0.6088 | 0.2209 | −0.4707 |
| −0.0273 | 0.1806 | −0.6523 | 2.4901 | 1.1051 | −0.5613 | 3.0018 | 1.2093 | −0.4704 |
| 3.0277 | 1.4451 | −0.6519 | 0.6116 | 0.3418 | −0.5612 | 2.4312 | 0.9969 | −0.4698 |
| 0.6117 | 0.4627 | −0.6517 | 2.9840 | 1.3422 | −0.5603 | 0.0832 | 0.0392 | −0.4697 |
| 2.4541 | 1.2242 | −0.6515 | 0.0223 | 0.1379 | −0.5601 | 0.6438 | 0.2983 | −0.4688 |
| 2.3665 | 1.2328 | −0.6502 | 2.4038 | 1.1147 | −0.5600 | 2.9350 | 1.2375 | −0.4688 |
| 2.9591 | 1.4759 | −0.6502 | 0.6514 | 0.4185 | −0.5594 | 2.3461 | 1.0054 | −0.4685 |
| 0.6586 | 0.5369 | −0.6501 | 2.3173 | 1.1220 | −0.5588 | 0.0553 | 0.1053 | −0.4675 |
| −0.0484 | 0.2520 | −0.6500 | 2.9160 | 1.3713 | −0.5587 | 2.2609 | 1.0117 | −0.4674 |
| 2.2787 | 1.2386 | −0.6490 | −0.0006 | 0.2075 | −0.5578 | 2.8679 | 1.2651 | −0.4672 |
| 0.7090 | 0.6087 | −0.6486 | 0.6955 | 0.4930 | −0.5578 | 0.6829 | 0.3739 | −0.4671 |
| 2.8903 | 1.5061 | −0.6485 | 2.2305 | 1.1269 | −0.5577 | 2.1754 | 1.0158 | −0.4662 |
| 2.1907 | 1.2417 | −0.6478 | 2.8476 | 1.3999 | −0.5571 | 2.8005 | 1.2921 | −0.4656 |
| −0.0647 | 0.3246 | −0.6477 | 2.1436 | 1.1292 | −0.5566 | 0.7267 | 0.4469 | −0.4655 |
| 0.7633 | 0.6779 | −0.6473 | 0.7443 | 0.5646 | −0.5563 | 0.0316 | 0.1730 | −0.4652 |
| 2.8211 | 1.5356 | −0.6468 | −0.0190 | 0.2784 | −0.5556 | 2.0899 | 1.0175 | −0.4652 |
| 2.1027 | 1.2419 | −0.6468 | 2.0566 | 1.1288 | −0.5555 | 2.0043 | 1.0169 | −0.4642 |
| 0.8215 | 0.7438 | −0.6461 | 2.7790 | 1.4278 | −0.5555 | 0.7758 | 0.5166 | −0.4641 |
| 2.0146 | 1.2390 | −0.6459 | 0.7981 | 0.6327 | −0.5550 | 2.7329 | 1.3185 | −0.4641 |
| −0.0765 | 0.3981 | −0.6454 | 1.9696 | 1.1258 | −0.5546 | 1.9187 | 1.0137 | −0.4633 |
| 2.7516 | 1.5645 | −0.6452 | 2.7101 | 1.4551 | −0.5539 | 0.0127 | 0.2422 | −0.4630 |
| 0.8838 | 0.8061 | −0.6450 | 0.8566 | 0.6969 | −0.5538 | 0.8305 | 0.5823 | −0.4629 |
| 1.9266 | 1.2330 | −0.6450 | 1.8828 | 1.1199 | −0.5538 | 2.6651 | 1.3443 | −0.4625 |
| 1.8389 | 1.2237 | −0.6442 | −0.0332 | 0.3503 | −0.5533 | 1.8332 | 1.0077 | −0.4624 |
| 0.9500 | 0.8643 | −0.6441 | 1.7961 | 1.1110 | −0.5530 | 0.8903 | 0.6434 | −0.4618 |
| 1.7515 | 1.2110 | −0.6436 | 0.9198 | 0.7567 | −0.5529 | 1.7479 | 0.9989 | −0.4617 |
| 2.6819 | 1.5926 | −0.6435 | 1.7098 | 1.0988 | −0.5523 | 1.6630 | 0.9869 | −0.4610 |
| 1.0198 | 0.9183 | −0.6434 | 2.6409 | 1.4817 | −0.5523 | 2.5970 | 1.3694 | −0.4610 |
| −0.0844 | 0.4722 | −0.6432 | 0.9874 | 0.8116 | −0.5521 | 0.9549 | 0.6997 | −0.4610 |
| 1.6647 | 1.1946 | −0.6430 | 1.6240 | 1.0832 | −0.5518 | −0.0019 | 0.3125 | −0.4608 |
| 1.0928 | 0.9680 | −0.6428 | 1.0588 | 0.8616 | −0.5515 | 1.5786 | 0.9717 | −0.4605 |
| 1.5787 | 1.1745 | −0.6426 | 1.5390 | 1.0640 | −0.5513 | 1.0238 | 0.7507 | −0.4603 |
| 1.1686 | 1.0132 | −0.6424 | −0.0434 | 0.4229 | −0.5511 | 1.4948 | 0.9529 | −0.4600 |
| 1.4937 | 1.1505 | −0.6423 | 1.1334 | 0.9067 | −0.5511 | 1.0965 | 0.7964 | −0.4598 |
| 1.2470 | 1.0539 | −0.6421 | 1.4548 | 1.0410 | −0.5510 | 1.4120 | 0.9303 | −0.4597 |
| 1.4099 | 1.1225 | −0.6421 | 1.2108 | 0.9470 | −0.5508 | 1.1722 | 0.8369 | −0.4596 |
| 1.3276 | 1.0903 | −0.6420 | 1.3719 | 1.0140 | −0.5508 | 1.3304 | 0.9036 | −0.4595 |
| 2.6118 | 1.6201 | −0.6419 | 1.2904 | 0.9827 | −0.5507 | 2.5286 | 1.3939 | −0.4595 |
| −0.0885 | 0.5466 | −0.6410 | 2.5715 | 1.5076 | −0.5507 | 1.2503 | 0.8726 | −0.4595 |
| 2.5414 | 1.6468 | −0.6403 | 2.5017 | 1.5328 | −0.5492 | −0.0123 | 0.3835 | −0.4587 |
| −0.0894 | 0.6212 | −0.6389 | −0.0498 | 0.4960 | −0.5490 | 2.4600 | 1.4178 | −0.4580 |
| 2.4707 | 1.6727 | −0.6387 | 2.4317 | 1.5573 | −0.5476 | 2.3911 | 1.4410 | −0.4565 |
| 2.3997 | 1.6979 | −0.6372 | −0.0527 | 0.5694 | −0.5468 | −0.0189 | 0.4551 | −0.4565 |
| −0.0868 | 0.6959 | −0.6367 | 2.3615 | 1.5810 | −0.5461 | 2.3221 | 1.4636 | −0.4551 |
| 2.3284 | 1.7222 | −0.6356 | −0.0520 | 0.6429 | −0.5447 | −0.0219 | 0.5269 | −0.4544 |
| −0.0810 | 0.7703 | −0.6347 | 2.2909 | 1.6040 | −0.5446 | 2.2527 | 1.4854 | −0.4536 |
| 2.2568 | 1.7457 | −0.6341 | 2.2201 | 1.6263 | −0.5432 | −0.0210 | 0.5989 | −0.4524 |
| −0.0720 | 0.8446 | −0.6326 | −0.0478 | 0.7163 | −0.5426 | 2.1832 | 1.5066 | −0.4522 |
| 2.1849 | 1.7683 | −0.6326 | 2.1490 | 1.6477 | −0.5417 | 2.1134 | 1.5271 | −0.4508 |
| 2.1127 | 1.7900 | −0.6312 | −0.0399 | 0.7895 | −0.5406 | −0.0163 | 0.6708 | −0.4504 |
| −0.0596 | 0.9184 | −0.6307 | 2.0777 | 1.6684 | −0.5403 | 2.0434 | 1.5468 | −0.4494 |
| 2.0403 | 1.8109 | −0.6297 | 2.0062 | 1.6883 | −0.5389 | −0.0077 | 0.7424 | −0.4484 |
| −0.0440 | 0.9916 | −0.6287 | −0.0284 | 0.8622 | −0.5387 | 1.9732 | 1.5657 | −0.4480 |
| 1.9675 | 1.8308 | −0.6283 | 1.9343 | 1.7072 | −0.5375 | 1.9026 | 1.5837 | −0.4467 |
| 1.8944 | 1.8496 | −0.6269 | −0.0131 | 0.9344 | −0.5368 | 0.0049 | 0.8135 | −0.4465 |
| −0.0252 | 1.0642 | −0.6269 | 1.8622 | 1.7250 | −0.5361 | 1.8318 | 1.6006 | −0.4454 |
| 1.8210 | 1.8672 | −0.6255 | 0.0061 | 1.0057 | −0.5350 | 0.0215 | 0.8838 | −0.4447 |
| −0.0029 | 1.1359 | −0.6251 | 1.7897 | 1.7417 | −0.5348 | 1.7607 | 1.6163 | −0.4441 |
| 1.7473 | 1.8835 | −0.6242 | 1.7170 | 1.7571 | −0.5335 | 0.0421 | 0.9531 | −0.4429 |
| 0.0230 | 1.2064 | −0.6233 | 0.0292 | 1.0759 | −0.5332 | 1.6893 | 1.6309 | −0.4428 |
| 1.6732 | 1.8984 | −0.6229 | 1.6439 | 1.7711 | −0.5322 | 1.6177 | 1.6440 | −0.4416 |
| 0.0526 | 1.2755 | −0.6217 | 0.0562 | 1.1448 | −0.5315 | 0.0670 | 1.0212 | −0.4413 |
| 1.5988 | 1.9117 | −0.6216 | 1.5705 | 1.7836 | −0.5310 | 1.5457 | 1.6557 | −0.4404 |
| 1.5241 | 1.9233 | −0.6204 | 0.0873 | 1.2121 | −0.5300 | 0.0960 | 1.0877 | −0.4397 |
| 0.0860 | 1.3431 | −0.6202 | 1.4968 | 1.7945 | −0.5298 | 1.4735 | 1.6659 | −0.4393 |
| 1.4491 | 1.9331 | −0.6192 | 1.4229 | 1.8037 | −0.5287 | 0.1294 | 1.1522 | −0.4382 |
| 0.1231 | 1.4087 | −0.6187 | 0.1224 | 1.2775 | −0.5285 | 1.4010 | 1.6743 | −0.4382 |
| 1.3738 | 1.9409 | −0.6181 | 1.3487 | 1.8109 | −0.5276 | 1.3283 | 1.6808 | −0.4371 |
| 0.1641 | 1.4721 | −0.6174 | 0.1617 | 1.3406 | −0.5271 | 0.1672 | 1.2144 | −0.4369 |
| 1.2983 | 1.9465 | −0.6171 | 1.2743 | 1.8160 | −0.5266 | 1.2553 | 1.6850 | −0.4361 |
| 0.2091 | 1.5329 | −0.6161 | 0.2051 | 1.4010 | −0.5259 | 0.2093 | 1.2739 | −0.4357 |
| 1.2226 | 1.9497 | −0.6161 | 1.1998 | 1.8185 | −0.5256 | 1.1823 | 1.6869 | −0.4352 |
| 1.1468 | 1.9500 | −0.6152 | 0.2526 | 1.4584 | −0.5248 | 0.2556 | 1.3303 | −0.4346 |
| 0.2580 | 1.5906 | −0.6151 | 1.1251 | 1.8183 | −0.5247 | 1.1091 | 1.6862 | −0.4344 |
| 1.0710 | 1.9472 | −0.6144 | 1.0505 | 1.8151 | −0.5240 | 0.3059 | 1.3832 | −0.4336 |

TABLE 1-continued

| Point Coordinates | | | | | | | | |
|---|---|---|---|---|---|---|---|---|
| 0.3109 | 1.6449 | −0.6141 | 0.3041 | 1.5124 | −0.5239 | 1.0361 | 1.6827 | −0.4336 |
| 0.9953 | 1.9411 | −0.6137 | 0.9760 | 1.8087 | −0.5233 | 0.9632 | 1.6760 | −0.4330 |
| 0.3676 | 1.6953 | −0.6133 | 0.3595 | 1.5625 | −0.5231 | 0.3601 | 1.4324 | −0.4329 |
| 0.9200 | 1.9315 | −0.6130 | 0.9019 | 1.7988 | −0.5227 | 0.8906 | 1.6658 | −0.4324 |
| 0.4280 | 1.7414 | −0.6127 | 0.4187 | 1.6082 | −0.5225 | 0.4180 | 1.4773 | −0.4323 |
| 0.8452 | 1.9180 | −0.6125 | 0.8283 | 1.7850 | −0.5222 | 0.8186 | 1.6519 | −0.4320 |
| 0.4916 | 1.7829 | −0.6123 | 0.4812 | 1.6494 | −0.5220 | 0.4792 | 1.5176 | −0.4318 |
| 0.7712 | 1.9004 | −0.6122 | 0.7556 | 1.7671 | −0.5219 | 0.7476 | 1.6339 | −0.4316 |
| 0.5582 | 1.8196 | −0.6120 | 0.5465 | 1.6859 | −0.5217 | 0.5431 | 1.5534 | −0.4315 |
| 0.6985 | 1.8782 | −0.6120 | 0.6841 | 1.7448 | −0.5217 | 0.6777 | 1.6115 | −0.4315 |
| 0.6273 | 1.8513 | −0.6119 | 0.6143 | 1.7177 | −0.5216 | 0.6095 | 1.5847 | −0.4314 |

| Section 7 | | | Section 8 | | | Section 9 | | |
|---|---|---|---|---|---|---|---|---|
| X | Y | Z' | X | Y | Z' | X | Y | Z' |
| 4.1241 | 0.3882 | −0.4133 | 4.0997 | 0.2772 | −0.3222 | 4.0655 | 0.1587 | −0.2312 |
| 4.1484 | 0.4011 | −0.4132 | 4.1233 | 0.2903 | −0.3221 | 4.0882 | 0.1721 | −0.2311 |
| 4.0968 | 0.3844 | −0.4130 | 4.0731 | 0.2730 | −0.3220 | 4.0396 | 0.1539 | −0.2311 |
| 4.1659 | 0.4222 | −0.4128 | 4.1400 | 0.3111 | −0.3217 | 4.1043 | 0.1927 | −0.2307 |
| 4.0697 | 0.3889 | −0.4126 | 4.0465 | 0.2769 | −0.3216 | 4.0135 | 0.1570 | −0.2307 |
| 4.1719 | 0.4415 | −0.4123 | 4.1458 | 0.3299 | −0.3212 | 4.1098 | 0.2109 | −0.2303 |
| 4.0437 | 0.3978 | −0.4120 | 4.0209 | 0.2852 | −0.3210 | 3.9883 | 0.1645 | −0.2302 |
| 4.1717 | 0.4616 | −0.4117 | 4.1456 | 0.3495 | −0.3207 | 4.1098 | 0.2298 | −0.2297 |
| 4.0182 | 0.4081 | −0.4114 | 3.9959 | 0.2948 | −0.3205 | 3.9637 | 0.1736 | −0.2296 |
| 4.1660 | 0.4809 | −0.4111 | 4.1401 | 0.3682 | −0.3201 | 4.1048 | 0.2480 | −0.2291 |
| 3.9931 | 0.4189 | −0.4108 | 3.9711 | 0.3051 | −0.3199 | 3.9393 | 0.1833 | −0.2290 |
| 4.1556 | 0.4981 | −0.4105 | 4.1301 | 0.3850 | −0.3195 | 4.0953 | 0.2644 | −0.2285 |
| 3.9680 | 0.4300 | −0.4102 | 3.9465 | 0.3157 | −0.3193 | 3.9151 | 0.1934 | −0.2285 |
| 4.1414 | 0.5124 | −0.4099 | 4.1163 | 0.3988 | −0.3189 | 4.0822 | 0.2780 | −0.2280 |
| 4.1251 | 0.5244 | −0.4094 | 4.1004 | 0.4104 | −0.3184 | 4.0669 | 0.2894 | −0.2275 |
| 4.1076 | 0.5348 | −0.4088 | 4.0834 | 0.4204 | −0.3179 | 4.0505 | 0.2990 | −0.2270 |
| 4.0896 | 0.5443 | −0.4084 | 3.8714 | 0.3475 | −0.3175 | 3.8414 | 0.2238 | −0.2267 |
| 3.8916 | 0.4633 | −0.4084 | 4.0658 | 0.4295 | −0.3174 | 4.0335 | 0.3078 | −0.2266 |
| 4.0270 | 0.5769 | −0.4067 | 4.0047 | 0.4605 | −0.3158 | 3.9740 | 0.3372 | −0.2250 |
| 3.8148 | 0.4956 | −0.4065 | 3.7958 | 0.3780 | −0.3157 | 3.7672 | 0.2529 | −0.2250 |
| 3.9644 | 0.6096 | −0.4050 | 3.9435 | 0.4915 | −0.3142 | 3.9145 | 0.3664 | −0.2235 |
| 3.7376 | 0.5271 | −0.4047 | 3.7200 | 0.4079 | −0.3140 | 3.6927 | 0.2813 | −0.2233 |
| 3.9020 | 0.6426 | −0.4033 | 3.8824 | 0.5227 | −0.3126 | 3.8550 | 0.3959 | −0.2219 |
| 3.6600 | 0.5577 | −0.4029 | 3.6438 | 0.4370 | −0.3122 | 3.6179 | 0.3089 | −0.2216 |
| 3.8396 | 0.6756 | −0.4016 | 3.8214 | 0.5539 | −0.3110 | 3.7956 | 0.4254 | −0.2204 |
| 3.5820 | 0.5871 | −0.4012 | 3.5671 | 0.4648 | −0.3105 | 3.5426 | 0.3354 | −0.2200 |
| 3.7770 | 0.7084 | −0.4000 | 3.7603 | 0.5849 | −0.3093 | 3.7361 | 0.4546 | −0.2188 |
| 3.5034 | 0.6154 | −0.3994 | 3.4898 | 0.4912 | −0.3089 | 3.4668 | 0.3605 | −0.2184 |
| 3.7144 | 0.7411 | −0.3983 | 3.6990 | 0.6158 | −0.3077 | 3.6764 | 0.4837 | −0.2173 |
| 3.4245 | 0.6425 | −0.3977 | 3.4122 | 0.5167 | −0.3072 | 3.3906 | 0.3846 | −0.2168 |
| 3.6518 | 0.7737 | −0.3966 | 3.6378 | 0.6467 | −0.3061 | 3.6168 | 0.5128 | −0.2158 |
| 3.3452 | 0.6685 | −0.3960 | 3.3344 | 0.5415 | −0.3056 | 3.3144 | 0.4082 | −0.2152 |
| 3.5892 | 0.8062 | −0.3949 | 3.5766 | 0.6776 | −0.3045 | 3.5572 | 0.5419 | −0.2142 |
| 3.2655 | 0.6936 | −0.3944 | 3.2564 | 0.5658 | −0.3040 | 3.2379 | 0.4314 | −0.2136 |
| 3.5264 | 0.8385 | −0.3933 | 3.5152 | 0.7082 | −0.3029 | 3.4975 | 0.5709 | −0.2127 |
| 3.1855 | 0.7177 | −0.3927 | 3.1782 | 0.5893 | −0.3024 | 3.1613 | 0.4539 | −0.2121 |
| 3.4632 | 0.8701 | −0.3916 | 3.4536 | 0.7382 | −0.3013 | 3.4375 | 0.5993 | −0.2112 |
| 3.1052 | 0.7409 | −0.3911 | 3.0996 | 0.6118 | −0.3008 | 3.0843 | 0.4755 | −0.2106 |
| 3.3997 | 0.9011 | −0.3900 | 3.3916 | 0.7677 | −0.2997 | 3.3773 | 0.6272 | −0.2097 |
| 3.0246 | 0.7629 | −0.3895 | 3.0207 | 0.6331 | −0.2993 | 3.0071 | 0.4960 | −0.2091 |
| 3.3358 | 0.9314 | −0.3884 | 3.3293 | 0.7966 | −0.2982 | 3.3168 | 0.6546 | −0.2082 |
| 2.9436 | 0.7836 | −0.3880 | 2.9415 | 0.6533 | −0.2977 | 2.9295 | 0.5156 | −0.2076 |
| 3.2717 | 0.9612 | −0.3867 | 3.2668 | 0.8249 | −0.2966 | 3.2562 | 0.6816 | −0.2067 |
| 2.8622 | 0.8029 | −0.3865 | 2.8619 | 0.6723 | −0.2963 | 2.8517 | 0.5341 | −0.2061 |
| 3.2073 | 0.9903 | −0.3851 | 3.2041 | 0.8528 | −0.2951 | 3.1953 | 0.7081 | −0.2052 |
| 2.7804 | 0.8208 | −0.3850 | 2.7820 | 0.6899 | −0.2948 | 2.7736 | 0.5515 | −0.2047 |
| 0.3823 | −0.1418 | −0.3845 | 3.1411 | 0.8801 | −0.2936 | 3.1342 | 0.7341 | −0.2037 |
| 0.4571 | −0.1031 | −0.3842 | 2.7018 | 0.7063 | −0.2934 | 2.6953 | 0.5678 | −0.2033 |
| 0.3003 | −0.1572 | −0.3839 | 3.0779 | 0.9069 | −0.2920 | 3.0729 | 0.7597 | −0.2023 |
| 2.6983 | 0.8371 | −0.3836 | 2.6213 | 0.7212 | −0.2920 | 2.6166 | 0.5828 | −0.2020 |
| 3.1427 | 1.0190 | −0.3836 | 2.5405 | 0.7347 | −0.2907 | 3.0114 | 0.7849 | −0.2008 |
| 0.5124 | −0.0407 | −0.3831 | 0.3707 | −0.1492 | −0.2906 | 2.5377 | 0.5966 | −0.2007 |
| 0.2310 | −0.1430 | −0.3827 | 3.0145 | 0.9333 | −0.2905 | 2.9498 | 0.8098 | −0.1994 |
| 2.6159 | 0.8518 | −0.3822 | 0.4436 | −0.1120 | −0.2904 | 2.4586 | 0.6090 | −0.1994 |
| 3.0778 | 1.0470 | −0.3820 | 0.2902 | −0.1642 | −0.2900 | 2.3792 | 0.6201 | −0.1981 |
| 0.5550 | 0.0313 | −0.3815 | 2.4594 | 0.7466 | −0.2894 | 2.8879 | 0.8342 | −0.1979 |
| 0.1737 | −0.1029 | −0.3809 | 0.4986 | −0.0514 | −0.2893 | 2.2996 | 0.6297 | −0.1969 |
| 2.5331 | 0.8649 | −0.3808 | 2.9509 | 0.9593 | −0.2890 | 2.8260 | 0.8582 | −0.1965 |
| 3.0126 | 1.0746 | −0.3804 | 0.2230 | −0.1504 | −0.2889 | 0.3370 | −0.1450 | −0.1961 |
| 0.5917 | 0.1062 | −0.3798 | 2.3781 | 0.7570 | −0.2881 | 0.4074 | −0.1069 | −0.1958 |
| 2.4500 | 0.8761 | −0.3795 | 0.5435 | 0.0170 | −0.2878 | 2.2199 | 0.6379 | −0.1957 |
| 2.9473 | 1.1017 | −0.3789 | 2.8871 | 0.9848 | −0.2876 | 0.2583 | −0.1599 | −0.1956 |

TABLE 1-continued

| Point Coordinates | | | | | | | | |
|---|---|---|---|---|---|---|---|---|
| 0.1322 | −0.0467 | −0.3788 | 0.1675 | −0.1114 | −0.2871 | 2.7638 | 0.8818 | −0.1951 |
| 2.3667 | 0.8856 | −0.3783 | 2.2965 | 0.7657 | −0.2869 | 0.4619 | −0.0482 | −0.1948 |
| 0.6266 | 0.1820 | −0.3780 | 0.5837 | 0.0881 | −0.2862 | 2.1399 | 0.6445 | −0.1946 |
| 2.8817 | 1.1283 | −0.3773 | 2.8231 | 1.0099 | −0.2861 | 0.1935 | −0.1460 | −0.1944 |
| 2.2832 | 0.8931 | −0.3771 | 2.2148 | 0.7726 | −0.2858 | 2.7015 | 0.9049 | −0.1937 |
| 0.0993 | 0.0151 | −0.3766 | 0.1275 | −0.0565 | −0.2850 | 2.0598 | 0.6495 | −0.1935 |
| 0.6636 | 0.2568 | −0.3763 | 0.6229 | 0.1598 | −0.2846 | 0.5099 | 0.0160 | −0.1935 |
| 2.1994 | 0.8987 | −0.3759 | 2.1328 | 0.7778 | −0.2846 | 0.1396 | −0.1084 | −0.1927 |
| 2.8159 | 1.1544 | −0.3758 | 2.7589 | 1.0344 | −0.2846 | 1.9796 | 0.6528 | −0.1925 |
| 2.1155 | 0.9022 | −0.3748 | 2.0508 | 0.7811 | −0.2836 | 2.6390 | 0.9277 | −0.1923 |
| 0.7048 | 0.3295 | −0.3747 | 2.6945 | 1.0585 | −0.2832 | 0.5553 | 0.0819 | −0.1921 |
| 0.0721 | 0.0795 | −0.3744 | 0.6650 | 0.2299 | −0.2831 | 1.8993 | 0.6543 | −0.1915 |
| 2.7499 | 1.1799 | −0.3743 | 0.0958 | 0.0035 | −0.2829 | 2.5763 | 0.9500 | −0.1909 |
| 2.0315 | 0.9036 | −0.3738 | 1.9687 | 0.7824 | −0.2826 | 0.6013 | 0.1474 | −0.1908 |
| 0.7509 | 0.3993 | −0.3732 | 0.7118 | 0.2971 | −0.2817 | 0.1013 | −0.0551 | −0.1907 |
| 1.9475 | 0.9026 | −0.3728 | 2.6300 | 1.0821 | −0.2817 | 1.8189 | 0.6536 | −0.1905 |
| 2.6836 | 1.2049 | −0.3728 | 1.8865 | 0.7815 | −0.2816 | 1.7386 | 0.6509 | −0.1897 |
| 0.0493 | 0.1456 | −0.3723 | 0.0701 | 0.0664 | −0.2808 | 2.5135 | 0.9719 | −0.1896 |
| 1.8635 | 0.8992 | −0.3719 | 1.8043 | 0.7783 | −0.2808 | 0.6511 | 0.2102 | −0.1896 |
| 0.8024 | 0.4655 | −0.3719 | 0.7633 | 0.3608 | −0.2805 | 1.6584 | 0.6458 | −0.1889 |
| 2.6172 | 1.2293 | −0.3713 | 2.5652 | 1.1052 | −0.2803 | 0.0729 | 0.0040 | −0.1887 |
| 1.7796 | 0.8931 | −0.3711 | 1.7223 | 0.7726 | −0.2800 | 0.7058 | 0.2690 | −0.1885 |
| 0.8592 | 0.5272 | −0.3708 | 0.8197 | 0.4205 | −0.2795 | 2.4505 | 0.9933 | −0.1882 |
| 1.6959 | 0.8842 | −0.3704 | 1.6404 | 0.7641 | −0.2792 | 1.5783 | 0.6383 | −0.1882 |
| 0.0313 | 0.2133 | −0.3701 | 2.5002 | 1.1278 | −0.2789 | 0.7648 | 0.3236 | −0.1876 |
| 0.9212 | 0.5840 | −0.3699 | 0.0493 | 0.1310 | −0.2787 | 1.4984 | 0.6282 | −0.1875 |
| 2.5505 | 1.2532 | −0.3698 | 1.5589 | 0.7528 | −0.2786 | 1.4190 | 0.6152 | −0.1869 |
| 1.6126 | 0.8723 | −0.3698 | 0.8808 | 0.4755 | −0.2786 | 0.8276 | 0.3738 | −0.1869 |
| 1.5298 | 0.8570 | −0.3692 | 1.4778 | 0.7384 | −0.2781 | 2.3874 | 1.0143 | −0.1869 |
| 0.9876 | 0.6357 | −0.3692 | 0.9462 | 0.5254 | −0.2779 | 0.0509 | 0.0659 | −0.1866 |
| 1.4476 | 0.8384 | −0.3688 | 1.3974 | 0.7207 | −0.2776 | 1.3401 | 0.5991 | −0.1865 |
| 1.0580 | 0.6818 | −0.3687 | 2.4351 | 1.1499 | −0.2775 | 0.8938 | 0.4196 | −0.1864 |
| 1.3664 | 0.8160 | −0.3685 | 1.0153 | 0.5702 | −0.2775 | 1.2619 | 0.5796 | −0.1861 |
| 1.1317 | 0.7227 | −0.3684 | 1.3178 | 0.6993 | −0.2773 | 0.9630 | 0.4608 | −0.1860 |
| 2.4836 | 1.2765 | −0.3684 | 1.0877 | 0.6097 | −0.2772 | 1.1847 | 0.5564 | −0.1859 |
| 1.2864 | 0.7894 | −0.3683 | 1.2394 | 0.6739 | −0.2771 | 1.0349 | 0.4973 | −0.1858 |
| 1.2080 | 0.7584 | −0.3683 | 1.1625 | 0.6441 | −0.2771 | 1.1089 | 0.5291 | −0.1858 |
| 0.0178 | 0.2820 | −0.3680 | 0.0335 | 0.1971 | −0.2766 | 2.3241 | 1.0348 | −0.1855 |
| 2.4165 | 1.2992 | −0.3669 | 2.3698 | 1.1714 | −0.2761 | 0.0337 | 0.1293 | −0.1846 |
| 0.0086 | 0.3514 | −0.3659 | 2.3042 | 1.1924 | −0.2747 | 2.2606 | 1.0549 | −0.1842 |
| 2.3491 | 1.3213 | −0.3655 | 0.0225 | 0.2642 | −0.2746 | 2.1970 | 1.0745 | −0.1829 |
| 2.2816 | 1.3427 | −0.3641 | 2.2385 | 1.2129 | −0.2734 | 0.0218 | 0.1940 | −0.1826 |
| 0.0033 | 0.4213 | −0.3638 | 0.0161 | 0.3319 | −0.2725 | 2.1332 | 1.0936 | −0.1816 |
| 2.2138 | 1.3636 | −0.3627 | 2.1727 | 1.2329 | −0.2720 | 0.0153 | 0.2595 | −0.1807 |
| 0.0018 | 0.4914 | −0.3618 | 2.1066 | 1.2523 | −0.2707 | 2.0693 | 1.1122 | −0.1803 |
| 2.1459 | 1.3839 | −0.3613 | 0.0139 | 0.4000 | −0.2706 | 2.0051 | 1.1302 | −0.1790 |
| 2.0777 | 1.4035 | −0.3600 | 2.0403 | 1.2710 | −0.2694 | 0.0136 | 0.3253 | −0.1787 |
| 0.0044 | 0.5616 | −0.3598 | 0.0158 | 0.4681 | −0.2686 | 1.9408 | 1.1475 | −0.1778 |
| 2.0093 | 1.4223 | −0.3586 | 1.9738 | 1.2890 | −0.2681 | 0.0166 | 0.3912 | −0.1769 |
| 0.0112 | 0.6316 | −0.3578 | 1.9071 | 1.3061 | −0.2668 | 1.8762 | 1.1641 | −0.1765 |
| 1.9406 | 1.4403 | −0.3573 | 0.0219 | 0.5361 | −0.2667 | 1.8115 | 1.1799 | −0.1753 |
| 1.8717 | 1.4573 | −0.3560 | 1.8401 | 1.3224 | −0.2655 | 0.0238 | 0.4568 | −0.1751 |
| 0.0221 | 0.7011 | −0.3560 | 0.0325 | 0.6036 | −0.2649 | 1.7465 | 1.1949 | −0.1741 |
| 1.8025 | 1.4733 | −0.3547 | 1.7729 | 1.3377 | −0.2643 | 0.0355 | 0.5219 | −0.1733 |
| 0.0372 | 0.7699 | −0.3542 | 0.0473 | 0.6703 | −0.2632 | 1.6813 | 1.2089 | −0.1729 |
| 1.7331 | 1.4882 | −0.3535 | 1.7054 | 1.3520 | −0.2631 | 1.6158 | 1.2219 | −0.1718 |
| 0.0566 | 0.8377 | −0.3524 | 1.6377 | 1.3651 | −0.2619 | 0.0517 | 0.5860 | −0.1717 |
| 1.6634 | 1.5019 | −0.3522 | 0.0666 | 0.7361 | −0.2615 | 1.5502 | 1.2339 | −0.1707 |
| 1.5934 | 1.5142 | −0.3511 | 1.5697 | 1.3771 | −0.2608 | 0.0724 | 0.6490 | −0.1701 |
| 0.0802 | 0.9043 | −0.3508 | 0.0901 | 0.8005 | −0.2599 | 1.4843 | 1.2448 | −0.1696 |
| 1.5231 | 1.5252 | −0.3499 | 1.5015 | 1.3878 | −0.2597 | 0.0975 | 0.7105 | −0.1686 |
| 0.1081 | 0.9693 | −0.3493 | 1.4331 | 1.3971 | −0.2586 | 1.4182 | 1.2543 | −0.1685 |
| 1.4526 | 1.5346 | −0.3488 | 0.1181 | 0.8632 | −0.2585 | 1.3518 | 1.2622 | −0.1675 |
| 0.1403 | 1.0324 | −0.3478 | 1.3644 | 1.4048 | −0.2576 | 0.1269 | 0.7702 | −0.1673 |
| 1.3818 | 1.5422 | −0.3478 | 0.1504 | 0.9240 | −0.2571 | 1.2853 | 1.2685 | −0.1666 |
| 1.3108 | 1.5480 | −0.3468 | 1.2956 | 1.4107 | −0.2566 | 0.1606 | 0.8276 | −0.1660 |
| 0.1768 | 1.0933 | −0.3465 | 0.1870 | 0.9824 | −0.2558 | 1.2185 | 1.2729 | −0.1657 |
| 1.2397 | 1.5516 | −0.3458 | 1.2265 | 1.4145 | −0.2556 | 0.1984 | 0.8826 | −0.1649 |
| 0.2177 | 1.1514 | −0.3453 | 1.1573 | 1.4161 | −0.2548 | 1.1517 | 1.2753 | −0.1648 |
| 1.1684 | 1.5530 | −0.3450 | 0.2279 | 1.0380 | −0.2547 | 1.0847 | 1.2754 | −0.1640 |
| 0.2630 | 1.2063 | −0.3443 | 1.0881 | 1.4153 | −0.2540 | 0.2402 | 0.9347 | −0.1639 |
| 1.0971 | 1.5518 | −0.3441 | 0.2729 | 1.0904 | −0.2537 | 1.0177 | 1.2731 | −0.1633 |
| 1.0258 | 1.5480 | −0.3434 | 1.0189 | 1.4119 | −0.2533 | 0.2858 | 0.9837 | −0.1630 |
| 0.3124 | 1.2577 | −0.3434 | 0.3218 | 1.1393 | −0.2529 | 0.9509 | 1.2683 | −0.1626 |
| 0.9547 | 1.5412 | −0.3428 | 0.9498 | 1.4056 | −0.2526 | 0.3351 | 1.0291 | −0.1623 |
| 0.3655 | 1.3052 | −0.3426 | 0.3744 | 1.1845 | −0.2522 | 0.8842 | 1.2607 | −0.1621 |
| 0.8840 | 1.5310 | −0.3422 | 0.8811 | 1.3962 | −0.2521 | 0.3877 | 1.0706 | −0.1617 |
| 0.4222 | 1.3487 | −0.3420 | 0.4303 | 1.2256 | −0.2517 | 0.8180 | 1.2500 | −0.1616 |

TABLE 1-continued

| Point Coordinates | | | | | | | | |
|---|---|---|---|---|---|---|---|---|
| 0.8139 | 1.5173 | −0.3418 | 0.8129 | 1.3837 | −0.2517 | 0.4433 | 1.1082 | −0.1613 |
| 0.4821 | 1.3877 | −0.3416 | 0.4890 | 1.2625 | −0.2513 | 0.7524 | 1.2359 | −0.1612 |
| 0.7446 | 1.4997 | −0.3415 | 0.7454 | 1.3675 | −0.2513 | 0.5015 | 1.1417 | −0.1610 |
| 0.5447 | 1.4222 | −0.3414 | 0.6789 | 1.3475 | −0.2511 | 0.6876 | 1.2183 | −0.1610 |
| 0.6764 | 1.4780 | −0.3413 | 0.5503 | 1.2951 | −0.2511 | 0.5618 | 1.1713 | −0.1609 |
| 0.6097 | 1.4523 | −0.3413 | 0.6137 | 1.3235 | −0.2511 | 0.6239 | 1.1968 | −0.1608 |

| Section 10 | | | Section 11 | | | Section 12 | | |
|---|---|---|---|---|---|---|---|---|
| X | Y | Z' | X | Y | Z' | X | Y | Z' |
| 4.0284 | 0.0294 | −0.1405 | 3.9940 | −0.0914 | −0.0497 | 3.9716 | −0.2134 | 0.0351 |
| 4.0032 | 0.0239 | −0.1404 | 3.9692 | −0.0975 | −0.0495 | 3.9464 | −0.2194 | 0.0353 |
| 4.0503 | 0.0432 | −0.1404 | 4.0154 | −0.0773 | −0.0495 | 3.9931 | −0.1991 | 0.0353 |
| 3.9775 | 0.0262 | −0.1400 | 3.9437 | −0.0954 | −0.0492 | 3.9207 | −0.2173 | 0.0356 |
| 4.0656 | 0.0638 | −0.1400 | 4.0303 | −0.0566 | −0.0491 | 4.0081 | −0.1783 | 0.0357 |
| 4.0709 | 0.0813 | −0.1396 | 3.9191 | −0.0887 | −0.0487 | 3.8958 | −0.2106 | 0.0361 |
| 3.9527 | 0.0330 | −0.1396 | 4.0353 | −0.0399 | −0.0487 | 4.0130 | −0.1614 | 0.0361 |
| 4.0712 | 0.0995 | −0.1390 | 3.8949 | −0.0804 | −0.0482 | 3.8714 | −0.2023 | 0.0366 |
| 3.9284 | 0.0415 | −0.1390 | 4.0356 | −0.0224 | −0.0482 | 4.0131 | −0.1439 | 0.0366 |
| 3.9044 | 0.0507 | −0.1385 | 3.8711 | −0.0714 | −0.0476 | 3.8473 | −0.1934 | 0.0372 |
| 4.0668 | 0.1172 | −0.1385 | 4.0316 | −0.0055 | −0.0476 | 4.0088 | −0.1269 | 0.0372 |
| 3.8805 | 0.0603 | −0.1379 | 4.0316 | −0.0055 | −0.0476 | 3.8232 | −0.1842 | 0.0377 |
| 4.0583 | 0.1332 | −0.1379 | 4.0312 | −0.0044 | −0.0476 | 4.0008 | −0.1114 | 0.0377 |
| 4.0460 | 0.1467 | −0.1374 | 4.0307 | −0.0033 | −0.0475 | 3.9894 | −0.0982 | 0.0382 |
| 4.0316 | 0.1578 | −0.1369 | 4.0303 | −0.0022 | −0.0475 | 3.9757 | −0.0872 | 0.0387 |
| 4.0158 | 0.1673 | −0.1364 | 4.0298 | −0.0011 | −0.0475 | 3.9606 | −0.0780 | 0.0392 |
| 3.8080 | 0.0894 | −0.1362 | 4.0293 | 0.0000 | −0.0474 | 3.7501 | −0.1565 | 0.0394 |
| 3.9995 | 0.1756 | −0.1360 | 4.0288 | 0.0011 | −0.0474 | 3.9449 | −0.0700 | 0.0396 |
| 3.7350 | 0.1171 | −0.1346 | 4.0282 | 0.0022 | −0.0474 | 3.8912 | −0.0451 | 0.0409 |
| 3.9421 | 0.2036 | −0.1345 | 4.0277 | 0.0033 | −0.0473 | 3.6765 | −0.1299 | 0.0410 |
| 3.8844 | 0.2310 | −0.1331 | 4.0271 | 0.0043 | −0.0473 | 3.8371 | −0.0212 | 0.0422 |
| 3.6616 | 0.1441 | −0.1329 | 4.0265 | 0.0054 | −0.0473 | 3.6026 | −0.1041 | 0.0426 |
| 3.8269 | 0.2586 | −0.1316 | 4.0260 | 0.0064 | −0.0472 | 3.7832 | 0.0032 | 0.0436 |
| 3.5879 | 0.1704 | −0.1313 | 4.0253 | 0.0074 | −0.0472 | 3.5285 | −0.0789 | 0.0442 |
| 3.7693 | 0.2862 | −0.1301 | 4.0247 | 0.0085 | −0.0471 | 3.7293 | 0.0277 | 0.0449 |
| 3.5139 | 0.1955 | −0.1297 | 4.0241 | 0.0095 | −0.0471 | 3.4539 | −0.0549 | 0.0458 |
| 3.7115 | 0.3134 | −0.1286 | 4.0237 | 0.0100 | −0.0471 | 3.6753 | 0.0519 | 0.0463 |
| 3.4393 | 0.2193 | −0.1282 | 3.8473 | −0.0621 | −0.0471 | 3.3789 | −0.0323 | 0.0473 |
| 3.6536 | 0.3404 | −0.1272 | 4.0234 | 0.0105 | −0.0471 | 3.6212 | 0.0759 | 0.0476 |
| 3.3645 | 0.2423 | −0.1266 | 4.0227 | 0.0115 | −0.0470 | 3.3036 | −0.0105 | 0.0488 |
| 3.5958 | 0.3674 | −0.1257 | 4.0220 | 0.0124 | −0.0470 | 3.5671 | 0.0999 | 0.0489 |
| 3.2895 | 0.2648 | −0.1251 | 4.0213 | 0.0134 | −0.0470 | 3.5131 | 0.1242 | 0.0502 |
| 3.5381 | 0.3947 | −0.1243 | 4.0206 | 0.0144 | −0.0469 | 3.2282 | 0.0109 | 0.0503 |
| 3.2144 | 0.2869 | −0.1236 | 4.0198 | 0.0153 | −0.0469 | 3.4591 | 0.1484 | 0.0516 |
| 3.4803 | 0.4219 | −0.1228 | 4.0191 | 0.0162 | −0.0468 | 3.1527 | 0.0317 | 0.0518 |
| 3.1391 | 0.3083 | −0.1221 | 4.0183 | 0.0172 | −0.0468 | 3.4050 | 0.1724 | 0.0529 |
| 3.4223 | 0.4487 | −0.1214 | 4.0175 | 0.0181 | −0.0468 | 3.0769 | 0.0519 | 0.0533 |
| 3.0635 | 0.3290 | −0.1206 | 4.0167 | 0.0190 | −0.0467 | 3.3508 | 0.1961 | 0.0542 |
| 3.3642 | 0.4751 | −0.1199 | 4.0159 | 0.0198 | −0.0467 | 3.0009 | 0.0711 | 0.0547 |
| 2.9877 | 0.3489 | −0.1191 | 4.0150 | 0.0207 | −0.0467 | 3.2964 | 0.2195 | 0.0555 |
| 3.3058 | 0.5011 | −0.1185 | 4.0142 | 0.0216 | −0.0466 | 2.9246 | 0.0893 | 0.0562 |
| 2.9117 | 0.3678 | −0.1177 | 4.0133 | 0.0224 | −0.0466 | 3.2419 | 0.2426 | 0.0568 |
| 3.2473 | 0.5267 | −0.1170 | 4.0124 | 0.0232 | −0.0466 | 2.8480 | 0.1065 | 0.0576 |
| 2.8354 | 0.3858 | −0.1162 | 4.0124 | 0.0232 | −0.0466 | 3.1873 | 0.2655 | 0.0581 |
| 3.1886 | 0.5519 | −0.1156 | 3.9989 | 0.0343 | −0.0461 | 2.7712 | 0.1227 | 0.0589 |
| 2.7588 | 0.4028 | −0.1149 | 3.9840 | 0.0436 | −0.0457 | 3.1325 | 0.2881 | 0.0594 |
| 3.1297 | 0.5767 | −0.1142 | 3.7751 | −0.0341 | −0.0454 | 2.6941 | 0.1377 | 0.0603 |
| 2.6821 | 0.4188 | −0.1135 | 3.9685 | 0.0517 | −0.0452 | 3.0777 | 0.3104 | 0.0607 |
| 3.0706 | 0.6011 | −0.1128 | 3.9134 | 0.0781 | −0.0438 | 2.6169 | 0.1518 | 0.0616 |
| 2.6050 | 0.4338 | −0.1122 | 3.7024 | −0.0073 | −0.0438 | 3.0227 | 0.3324 | 0.0620 |
| 3.0114 | 0.6252 | −0.1114 | 3.8579 | 0.1037 | −0.0424 | 2.5394 | 0.1648 | 0.0629 |
| 2.5278 | 0.4476 | −0.1109 | 3.6294 | 0.0189 | −0.0422 | 2.9676 | 0.3542 | 0.0633 |
| 2.9520 | 0.6489 | −0.1101 | 3.8026 | 0.1294 | −0.0410 | 2.4617 | 0.1767 | 0.0641 |
| 2.4503 | 0.4603 | −0.1096 | 3.5562 | 0.0443 | −0.0406 | 2.9124 | 0.3757 | 0.0646 |
| 2.8925 | 0.6723 | −0.1087 | 3.7472 | 0.1552 | −0.0397 | 2.3839 | 0.1876 | 0.0654 |
| 2.3726 | 0.4717 | −0.1083 | 3.4826 | 0.0688 | −0.0390 | 2.8571 | 0.3970 | 0.0658 |
| 2.8328 | 0.6953 | −0.1073 | 3.6917 | 0.1806 | −0.0383 | 2.3059 | 0.1975 | 0.0666 |
| 2.2947 | 0.4820 | −0.1071 | 3.4087 | 0.0922 | −0.0375 | 2.8017 | 0.4180 | 0.0671 |
| 2.7730 | 0.7180 | −0.1060 | 3.6361 | 0.2059 | −0.0369 | 2.2277 | 0.2062 | 0.0677 |
| 2.2167 | 0.4909 | −0.1059 | 3.3344 | 0.1147 | −0.0360 | 2.7461 | 0.4387 | 0.0683 |
| 2.1384 | 0.4985 | −0.1048 | 3.5806 | 0.2313 | −0.0355 | 2.1494 | 0.2140 | 0.0689 |
| 2.7131 | 0.7403 | −0.1046 | 3.2598 | 0.1363 | −0.0345 | 2.6905 | 0.4591 | 0.0696 |
| 2.0601 | 0.5047 | −0.1037 | 3.5251 | 0.2568 | −0.0341 | 2.0710 | 0.2206 | 0.0700 |
| 2.6530 | 0.7622 | −0.1033 | 3.1850 | 0.1572 | −0.0330 | 2.6347 | 0.4792 | 0.0708 |
| 1.9815 | 0.5094 | −0.1026 | 3.4696 | 0.2823 | −0.0327 | 1.9925 | 0.2262 | 0.0711 |
| 2.5927 | 0.7838 | −0.1019 | 3.1101 | 0.1775 | −0.0315 | 2.5789 | 0.4991 | 0.0720 |
| 1.9029 | 0.5125 | −0.1016 | 3.4140 | 0.3075 | −0.0313 | 1.9139 | 0.2308 | 0.0721 |

TABLE 1-continued

| Point Coordinates | | | | | | | | |
|---|---|---|---|---|---|---|---|---|
| 0.2806 | −0.1255 | −0.1009 | 3.0350 | 0.1974 | −0.0301 | 1.8353 | 0.2344 | 0.0732 |
| 1.8242 | 0.5139 | −0.1007 | 3.3582 | 0.3324 | −0.0300 | 2.5229 | 0.5186 | 0.0732 |
| 2.5324 | 0.8050 | −0.1006 | 2.9597 | 0.2164 | −0.0286 | 1.7566 | 0.2369 | 0.0742 |
| 0.3491 | −0.0869 | −0.1006 | 3.3022 | 0.3569 | −0.0286 | 2.4668 | 0.5377 | 0.0745 |
| 0.2035 | −0.1392 | −0.1004 | 3.2461 | 0.3811 | −0.0273 | 1.6778 | 0.2385 | 0.0751 |
| 1.7455 | 0.5136 | −0.0997 | 2.8841 | 0.2344 | −0.0272 | 2.4105 | 0.5566 | 0.0757 |
| 0.4058 | −0.0323 | −0.0997 | 3.1899 | 0.4049 | −0.0259 | 1.5990 | 0.2392 | 0.0761 |
| 2.4718 | 0.8258 | −0.0993 | 2.8083 | 0.2516 | −0.0258 | 2.3542 | 0.5751 | 0.0769 |
| 0.1415 | −0.1244 | −0.0992 | 3.1335 | 0.4284 | −0.0246 | 1.5202 | 0.2388 | 0.0770 |
| 1.6668 | 0.5113 | −0.0989 | 2.7323 | 0.2677 | −0.0245 | 1.4414 | 0.2376 | 0.0779 |
| 0.4610 | 0.0238 | −0.0987 | 3.0769 | 0.4516 | −0.0232 | 2.2977 | 0.5932 | 0.0780 |
| 1.5881 | 0.5071 | −0.0981 | 2.6560 | 0.2829 | −0.0231 | 1.3626 | 0.2355 | 0.0788 |
| 2.4111 | 0.8461 | −0.0980 | 3.0202 | 0.4745 | −0.0219 | 2.2411 | 0.6110 | 0.0792 |
| 0.5145 | 0.0815 | −0.0977 | 2.5795 | 0.2971 | −0.0218 | 1.2838 | 0.2324 | 0.0796 |
| 0.0910 | −0.0865 | −0.0975 | 2.9634 | 0.4971 | −0.0206 | 2.1843 | 0.6284 | 0.0804 |
| 1.5095 | 0.5008 | −0.0973 | 2.5028 | 0.3102 | −0.0205 | 1.2051 | 0.2285 | 0.0804 |
| 2.3503 | 0.8661 | −0.0967 | 2.4259 | 0.3222 | −0.0193 | 1.1263 | 0.2237 | 0.0812 |
| 0.5693 | 0.1380 | −0.0967 | 2.9064 | 0.5193 | −0.0193 | 2.1275 | 0.6454 | 0.0816 |
| 1.4311 | 0.4922 | −0.0967 | 2.3488 | 0.3332 | −0.0181 | 1.0477 | 0.2181 | 0.0820 |
| 1.3530 | 0.4813 | −0.0961 | 2.8494 | 0.5413 | −0.0180 | 2.0705 | 0.6620 | 0.0827 |
| 0.6281 | 0.1903 | −0.0959 | 2.2716 | 0.3431 | −0.0169 | 0.9690 | 0.2117 | 0.0827 |
| 0.0573 | −0.0333 | −0.0956 | 2.7922 | 0.5629 | −0.0167 | 0.8905 | 0.2044 | 0.0834 |
| 1.2753 | 0.4676 | −0.0955 | 2.1942 | 0.3518 | −0.0157 | 2.0133 | 0.6782 | 0.0838 |
| 2.2893 | 0.8857 | −0.0954 | 2.7349 | 0.5843 | −0.0154 | 0.8120 | 0.1964 | 0.0841 |
| 0.6916 | 0.2371 | −0.0953 | 2.1166 | 0.3594 | −0.0146 | 0.7335 | 0.1877 | 0.0848 |
| 1.1981 | 0.4511 | −0.0951 | 2.6774 | 0.6054 | −0.0141 | 1.9561 | 0.6940 | 0.0850 |
| 0.7584 | 0.2791 | −0.0949 | 2.0390 | 0.3658 | −0.0135 | 0.6552 | 0.1783 | 0.0854 |
| 1.1216 | 0.4314 | −0.0948 | 2.6199 | 0.6261 | −0.0128 | 0.5769 | 0.1682 | 0.0861 |
| 0.8277 | 0.3170 | −0.0946 | 1.9612 | 0.3711 | −0.0124 | 1.8987 | 0.7093 | 0.0861 |
| 1.0461 | 0.4084 | −0.0945 | 2.5622 | 0.6465 | −0.0116 | 0.4986 | 0.1576 | 0.0867 |
| 0.8989 | 0.3513 | −0.0944 | 1.8833 | 0.3751 | −0.0114 | 1.8412 | 0.7242 | 0.0872 |
| 0.9718 | 0.3817 | −0.0944 | 1.8053 | 0.3779 | −0.0104 | 0.4205 | 0.1465 | 0.0873 |
| 2.2282 | 0.9049 | −0.0942 | 2.5044 | 0.6666 | −0.0103 | 0.3425 | 0.1340 | 0.0879 |
| 0.0355 | 0.0260 | −0.0936 | 1.7273 | 0.3793 | −0.0094 | 1.7836 | 0.7387 | 0.0883 |
| 2.1670 | 0.9237 | −0.0929 | 2.4465 | 0.6863 | −0.0091 | 0.2651 | 0.1185 | 0.0883 |
| 0.0192 | 0.0871 | −0.0917 | 1.6493 | 0.3793 | −0.0085 | 0.1886 | 0.0986 | 0.0886 |
| 2.1056 | 0.9420 | −0.0917 | 2.3884 | 0.7058 | −0.0078 | 0.1124 | 0.0778 | 0.0889 |
| 2.0441 | 0.9599 | −0.0904 | 1.5712 | 0.3778 | −0.0076 | 1.7258 | 0.7527 | 0.0894 |
| 0.0087 | 0.1495 | −0.0898 | 1.4932 | 0.3747 | −0.0068 | 0.0342 | 0.0667 | 0.0895 |
| 1.9824 | 0.9772 | −0.0892 | 2.3302 | 0.7248 | −0.0066 | 1.6679 | 0.7661 | 0.0904 |
| 1.9205 | 0.9939 | −0.0880 | 1.4152 | 0.3699 | −0.0060 | −0.0440 | 0.0673 | 0.0905 |
| 0.0038 | 0.2126 | −0.0879 | 2.2719 | 0.7435 | −0.0054 | 1.6099 | 0.7790 | 0.0915 |
| 1.8585 | 1.0101 | −0.0868 | 1.3373 | 0.3633 | −0.0053 | −0.0974 | 0.0919 | 0.0918 |
| 0.0045 | 0.2760 | −0.0861 | 1.2596 | 0.3550 | −0.0046 | 1.5517 | 0.7913 | 0.0925 |
| 1.7962 | 1.0255 | −0.0856 | 2.2135 | 0.7619 | −0.0041 | 1.4934 | 0.8029 | 0.0936 |
| 1.7338 | 1.0403 | −0.0844 | 1.1821 | 0.3447 | −0.0040 | −0.1289 | 0.1402 | 0.0936 |
| 0.0104 | 0.3392 | −0.0843 | 1.1049 | 0.3325 | −0.0034 | 1.4349 | 0.8139 | 0.0946 |
| 1.6712 | 1.0543 | −0.0833 | 0.2397 | −0.0121 | −0.0032 | −0.1353 | 0.1983 | 0.0953 |
| 0.0213 | 0.4018 | −0.0827 | 0.1662 | −0.0387 | −0.0031 | 1.3763 | 0.8241 | 0.0955 |
| 1.6084 | 1.0675 | −0.0822 | 1.0279 | 0.3183 | −0.0029 | 1.3175 | 0.8334 | 0.0965 |
| 1.5454 | 1.0798 | −0.0811 | 2.1549 | 0.7799 | −0.0029 | −0.1296 | 0.2568 | 0.0969 |
| 0.0368 | 0.4636 | −0.0811 | 0.3063 | 0.0289 | −0.0028 | 1.2586 | 0.8420 | 0.0974 |
| 1.4821 | 1.0909 | −0.0800 | 0.9514 | 0.3019 | −0.0025 | 1.1995 | 0.8496 | 0.0984 |
| 0.0569 | 0.5241 | −0.0796 | 0.0889 | −0.0462 | −0.0024 | −0.1164 | 0.3143 | 0.0984 |
| 1.4187 | 1.1009 | −0.0790 | 0.0889 | −0.0462 | −0.0024 | 1.1404 | 0.8564 | 0.0992 |
| 0.0816 | 0.5831 | −0.0782 | 0.3727 | 0.0702 | −0.0024 | −0.0979 | 0.3704 | 0.0998 |
| 1.3550 | 1.1096 | −0.0780 | 0.8754 | 0.2833 | −0.0022 | 1.0810 | 0.8622 | 0.1001 |
| 1.2911 | 1.1167 | −0.0770 | 0.4403 | 0.1098 | −0.0020 | 1.0216 | 0.8669 | 0.1009 |
| 0.1105 | 0.6402 | −0.0769 | 0.8000 | 0.2621 | −0.0019 | −0.0740 | 0.4246 | 0.1011 |
| 1.2270 | 1.1223 | −0.0761 | 0.5092 | 0.1468 | −0.0018 | 0.9621 | 0.8703 | 0.1017 |
| 0.1435 | 0.6951 | −0.0757 | 2.0963 | 0.7974 | −0.0017 | −0.0451 | 0.4764 | 0.1023 |
| 1.1628 | 1.1260 | −0.0753 | 0.7255 | 0.2380 | −0.0017 | 0.9025 | 0.8723 | 0.1025 |
| 0.1805 | 0.7476 | −0.0746 | 0.5799 | 0.1807 | −0.0016 | 0.8428 | 0.8728 | 0.1032 |
| 1.0984 | 1.1279 | −0.0744 | 0.6520 | 0.2110 | −0.0016 | −0.0116 | 0.5255 | 0.1033 |
| 1.0340 | 1.1276 | −0.0737 | 0.0312 | −0.0270 | −0.0011 | 0.7831 | 0.8715 | 0.1039 |
| 0.2212 | 0.7973 | −0.0736 | 2.0374 | 0.8145 | −0.0006 | 0.0260 | 0.5717 | 0.1042 |
| 0.9695 | 1.1251 | −0.0730 | −0.0111 | 0.0155 | 0.0006 | 0.7234 | 0.8684 | 0.1045 |
| 0.2655 | 0.8441 | −0.0728 | −0.0111 | 0.0155 | 0.0006 | 0.0674 | 0.6147 | 0.1049 |
| 0.9052 | 1.1199 | −0.0724 | 1.9784 | 0.8311 | 0.0006 | 0.6639 | 0.8631 | 0.1050 |
| 0.3131 | 0.8875 | −0.0721 | 1.9193 | 0.8472 | 0.0018 | 0.6046 | 0.8557 | 0.1055 |
| 0.8412 | 1.1120 | −0.0719 | −0.0327 | 0.0718 | 0.0024 | 0.1122 | 0.6542 | 0.1055 |
| 0.3638 | 0.9274 | −0.0716 | 1.8600 | 0.8628 | 0.0029 | 0.5456 | 0.8458 | 0.1059 |
| 0.7776 | 1.1011 | −0.0714 | 1.8006 | 0.8778 | 0.0041 | 0.1598 | 0.6903 | 0.1060 |
| 0.4173 | 0.9635 | −0.0712 | −0.0421 | 0.1315 | 0.0043 | 0.4871 | 0.8332 | 0.1063 |
| 0.7145 | 1.0870 | −0.0711 | 1.7410 | 0.8923 | 0.0052 | 0.2100 | 0.7229 | 0.1064 |
| 0.4734 | 0.9956 | −0.0709 | −0.0443 | 0.1920 | 0.0060 | 0.4292 | 0.8178 | 0.1065 |
| 0.6523 | 1.0695 | −0.0709 | 1.6812 | 0.9061 | 0.0063 | 0.2624 | 0.7519 | 0.1066 |

TABLE 1-continued

| Point Coordinates | | | | | | | | |
|---|---|---|---|---|---|---|---|---|
| 0.5314 | 1.0240 | −0.0708 | 1.6213 | 0.9192 | 0.0074 | 0.3723 | 0.7992 | 0.1066 |
| 0.5912 | 1.0486 | −0.0708 | −0.0413 | 0.2526 | 0.0078 | 0.3166 | 0.7773 | 0.1067 |

It will also be appreciated that the exemplary airfoil(s) disclosed in the above Table may be scaled up or down geometrically for use in other similar designs. Consequently, the coordinate values set forth in the Table may be scaled upwardly or downwardly such that the airfoil profile shape remains unchanged. A scaled version of the coordinates in the Table would be represented by X, Y and Z coordinate values of the Table multiplied or divided by a constant.

While various embodiments are described herein, it will be appreciated from the specification that various combinations of elements, variations, or improvements therein may be made by those skilled in the art, and are within the scope of the invention.

What is claimed is:

1. An article of manufacture, the article having a nominal profile substantially in accordance with Cartesian coordinate values of X, Y and Z set forth in Table 1 and wherein X and Y are distances in inches which, when connected by smooth continuing arcs, define airfoil profile sections at each distance Z in inches, the profile sections at the Z distances being joined smoothly with one another to form a complete airfoil shape.

2. An article of manufacture according to claim 1, wherein the article comprises an airfoil.

3. An article of manufacture according to claim 2, wherein said article shape lies in an envelope within ±0.160 inches in a direction normal to any article surface location.

4. An article of manufacture according to claim 1, wherein the article comprises a turbine bucket airfoil.

5. A turbine bucket airfoil comprising a plurality of rotor buckets, each of said buckets including an airfoil having an airfoil shape, said airfoil having a nominal profile substantially in accordance with Cartesian coordinate values of X, Y and Z set forth in Table 1, wherein X and Y are distances in inches which, when connected by smooth continuing arcs, define the airfoil profile sections at each distance Z in inches, the profile sections at the Z distances being joined smoothly with one another to form a complete airfoil shape.

6. A turbine comprising a plurality of buckets, each of said buckets including an airfoil having an uncoated nominal airfoil profile substantially in accordance with Cartesian coordinate values of X, Y and Z set forth in Table 1, wherein X and Y are distances in inches which, when connected by smooth continuing arcs, define airfoil profile sections at each distance Z in inches, the profile sections at the Z distances being joined smoothly with one another to form a complete airfoil shape, the X and Y distances being scalable as a function of the same constant or number to provide a scaled-up or scaled-down airfoil.

7. A turbine according to claim 6 wherein the bucket comprises a first stage bucket.

8. A turbine according to claim 6 wherein said airfoil lies in an envelope within ±0.160 inches in a direction normal to any airfoil surface location.

9. A turbine according to claim 6 wherein said airfoil comprises a gas turbine airfoil.

* * * * *